US011199000B2

(12) United States Patent
Matiere

(10) Patent No.: US 11,199,000 B2
(45) Date of Patent: Dec. 14, 2021

(54) METHOD FOR PRODUCING A REINFORCED CONCRETE PART, AND THUS-PRODUCED PART

(75) Inventor: Marcel Matiere, Aurillac (FR)

(73) Assignee: SOCIETE CIVILE DE BREVETS MATIERE, Aurillac (FR)

( * ) Notice: Subject to any disclaimer, the term of this patent is extended or adjusted under 35 U.S.C. 154(b) by 1157 days.

(21) Appl. No.: 13/133,555

(22) PCT Filed: Dec. 9, 2009

(86) PCT No.: PCT/FR2009/052468
§ 371 (c)(1),
(2), (4) Date: Jun. 8, 2011

(87) PCT Pub. No.: WO2010/067023
PCT Pub. Date: Jun. 17, 2010

(65) Prior Publication Data

US 2011/0244211 A1 Oct. 6, 2011

(30) Foreign Application Priority Data

Dec. 9, 2008 (FR) ..... 0858407

(51) Int. Cl.
*E04B 1/22* (2006.01)
*E04C 5/03* (2006.01)
*E04C 5/06* (2006.01)

(52) U.S. Cl.
CPC ..... *E04B 1/22* (2013.01); *E04C 5/03* (2013.01); *E04C 5/0604* (2013.01); *Y10T 428/249923* (2015.04)

(58) Field of Classification Search
USPC ..... 264/333
See application file for complete search history.

(56) References Cited

U.S. PATENT DOCUMENTS 843,843 A 2/1907 Reavis
3,245,190 A * 4/1966 Reiland ..... E04C 3/34 52/649.3

(Continued)

FOREIGN PATENT DOCUMENTS

DE 801 175 C 12/1950
DE 87 17 395 U1 4/1988

(Continued)

OTHER PUBLICATIONS

EPO, EPO machine translation of detailed description and claims of DE801175, dated Mar. 16, 2017, Detailed Description pp. 1-3, Claims p. 1.*

(Continued)

*Primary Examiner* — Atul P. Khare
(74) *Attorney, Agent, or Firm* — Nixon & Vanderhye

(57) ABSTRACT

A method for producing a reinforced concrete part, having a tensioned portion subjected to pull stresses and tending to stretch under the load, and which includes a reinforcing frame with at least one tensioned longitudinal bar rigidly connected to the concrete by an adhesive connection that determines a tangential adhesive stress along the bar that varies on the basis of applied pull stresses. Each tensioned longitudinal bar has, on at least one portion of the length thereof, a discontinuous series of spaced blocking areas that each include a plurality of elements for anchoring into the concrete and which are separated from each other by a series of sliding areas, in each of which an increase in the adhesion stress above a limit value causes the bar to disengage, without disrupting the concrete, on at least a portion of the length between the two blocking areas with an extension of the bar corresponding to applied pull stresses, the extension being distributed over the entire length of the disengaged portion of the bar.

19 Claims, 6 Drawing Sheets

(56) References Cited

U.S. PATENT DOCUMENTS

| | | | | |
|---|---|---|---|---|
| 3,554,270 | A * | 1/1971 | Gelfand | B22D 19/04 164/108 |
| 4,648,224 | A * | 3/1987 | Kitta | E04C 5/07 428/372 |
| 2002/0040558 | A1 | 4/2002 | Matiere | |
| 2004/0211678 | A1* | 10/2004 | Edmondson | 205/730 |
| 2009/0022980 | A1 | 1/2009 | Sugimoto et al. | |

FOREIGN PATENT DOCUMENTS

| | | | | |
|---|---|---|---|---|
| EP | 1 191 163 | A1 | | 3/2002 |
| FR | 420 102 | A | | 9/1911 |
| FR | 532 620 | A | | 2/1922 |
| FR | 597 888 | A | | 4/1925 |
| FR | 1 380 233 | A | | 11/1964 |
| JP | 2006-233614 | A | * | 9/2006 |
| JP | 2006 233614 | A | | 9/2006 |

OTHER PUBLICATIONS

International Search Report, dated Apr. 14, 2010, from corresponding PCT application.

* cited by examiner

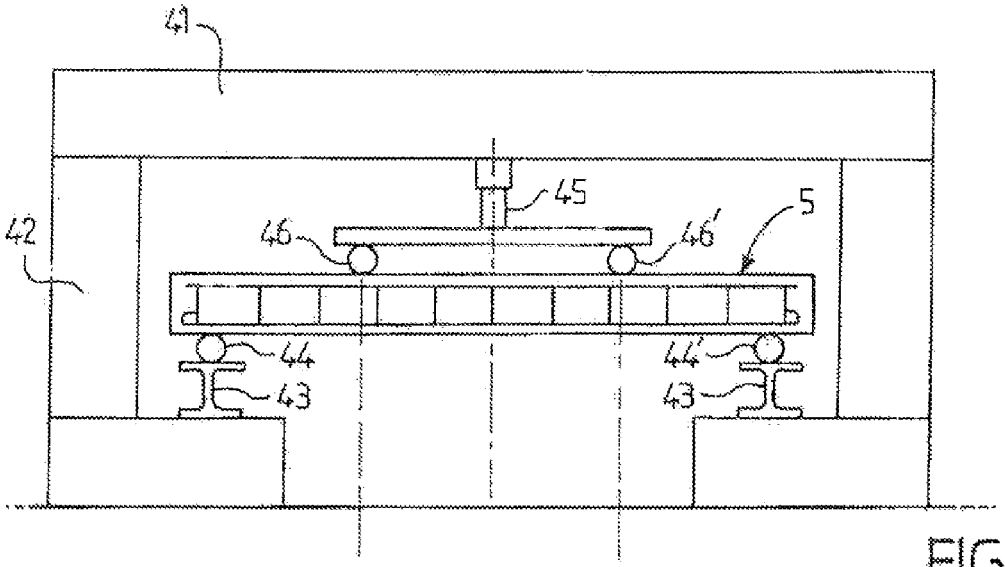
FIG.4
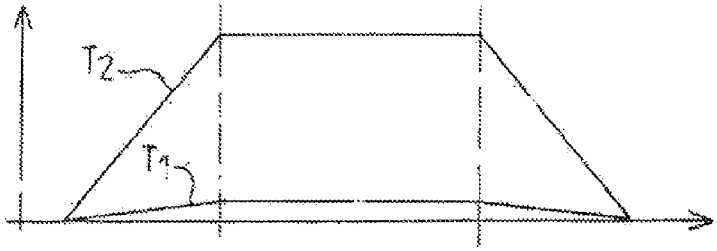
FIG.4a
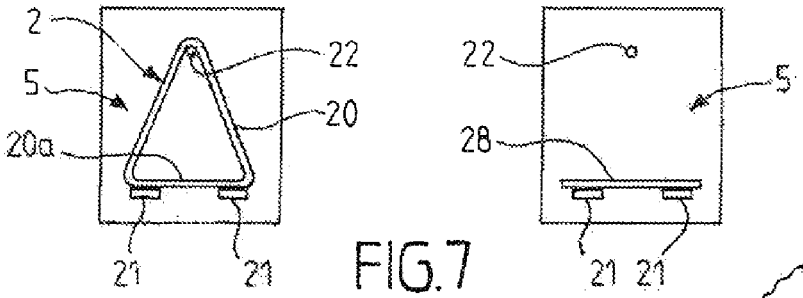
FIG.7
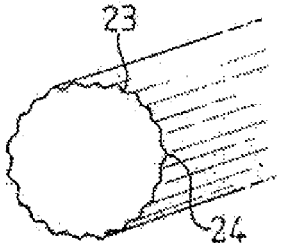
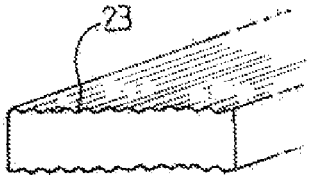
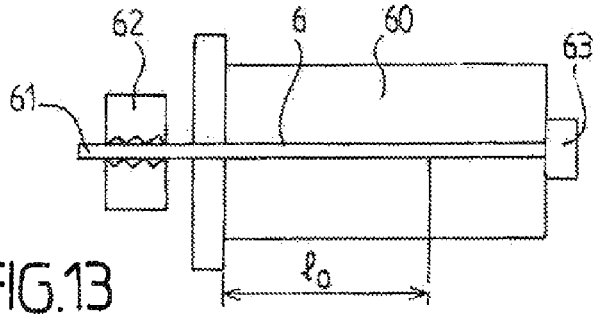
FIG.13
FIG.17

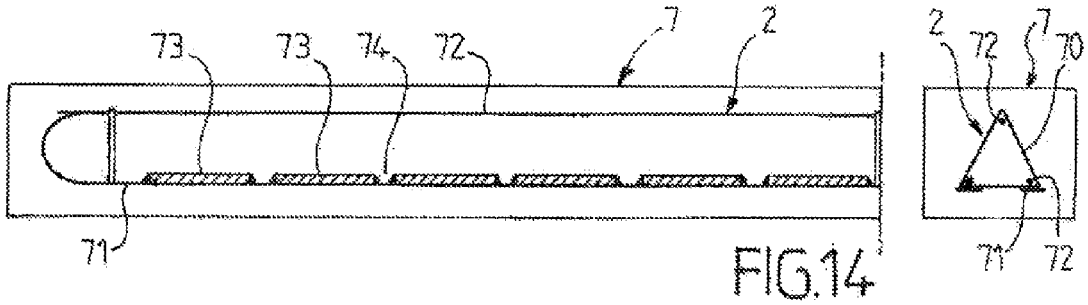
FIG.14
| N° | No crack | | 0.1 mm crack | | | 0.2 mm crack | | | 0.3 mm crack | | | 0.5 mm crack | | |
|---|---|---|---|---|---|---|---|---|---|---|---|---|---|---|
| | | | Deflection | | | Deflection | | | Deflection | | | Deflection | | |
| Beam | Load | Deflection | Load | | Number | Load | | Number | Load | | Number | Load | | Number |
| P061 | 7.5 | 3 | 15 | 5 | 6 | **20** | 7 | 8 | **30** | 10 | 10 | 36 | 13 | 10 |
| P062 | 5 | 1 | 15 | 5 | 6 | **25** | 8 | 9 | **30** | 10 | 9 | 33 | 11 | 9 |
| P063 | 7.5 | 3 | 15 | 6 | 7 | **25** | 9 | 8 | **30** | 10 | 8 | 39 | 15 | 9 |
| P064 | 5 | 2 | 15 | 5 | 4 | 20 | 6 | 7 | 26 | 7 | 7 | 37 | 15 | 9 |
| P065 | 7.5 | 3 | 15 | 5 | 4 | 20 | 6 | 8 | 25 | 8 | 8 | 33 | 12 | 8 |
| P101 | 7.5 | 2 | 15 | 4 | 3 | **33** | 9 | 9 | **36** | 10 | 10 | 39 | 12 | 10 |
| P102 | 7.5 | 2 | 20 | 6 | 8 | **30** | 8 | 9 | **39** | 12 | 9 | 41 | 14 | 10 |
| P103 | 7.5 | 4 | 15 | 9 | 6 | 20 | 9 | 7 | 30 | 10 | 9 | 36 | 13 | 9 |
| P104 | 7.5 | 2 | 15 | 4 | 6 | 20 | 6 | 7 | 30 | 9 | 10 | 36 | 12 | 10 |
| P105 | 5 | 2 | 15 | 5 | 7 | 20 | 6 | 9 | 25 | 8 | 10 | 36 | 14 | 10 |
| P141 | 10 | 2 | 20 | 5 | 4 | **25** | 6 | 4 | **33** | 8 | 9 | 43 | 16 | 12 |
| P142 | 7.5 | 2 | 15 | 5 | 5 | **25** | 7 | 9 | **36** | 10 | 9 | 39 | 12 | 10 |
| P143 | 5 | 1 | 10 | 2.5 | 2 | 20 | 5 | 6 | 30 | 8 | 8 | 36 | 11 | 9 |
| P144 | 7.5 | 2 | 15 | 4 | 4 | 15 | 4 | 4 | 20 | 5 | 4 | 33 | 9 | 5 |
| P145 | 10 | 3 | 15 | 5 | 2 | 20 | 6 | 4 | 30 | 8 | 6 | 36 | 11 | 7 |
FIG.15
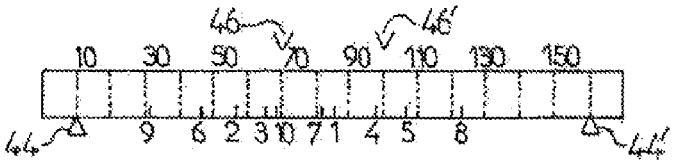
| Location of the crack | | 85 | 57 | 66.5 | 99 | 107.5 | 46 | 81.5 | 123.5 | 31 | 69 | |
|---|---|---|---|---|---|---|---|---|---|---|---|---|
| Load (kN) | Deflection (mm) | f1 e | f2 e | f3 e | f4 e | f5 e | f6 e | f7 e | f8 e | f9 e | f10 e | Σ crack opening |
| 5 | 1 | | | | | | | | | | | 0.00 |
| 7.5 | 2 | | | | | | | | | | | 0.00 |
| 10 | 3 | 0.05 | | | | | | | | | | 0.00 |
| 15 | 5 | 0.05 | 0.05 | 0.05 | 0.05 | 0.05 | | | | | | 0.25 |
| 20 | 6 | 0.10 | 0.05 | 0.10 | 0.10 | 0.10 | 0.05 | 0.05 | 0.05 | | | 0.50 |
| 25 | 7 | 0.10 | 0.05 | 0.10 | 0.10 | 0.10 | 0.05 | 0.05 | 0.05 | | | 0.50 |
| 30 | 8 | 0.20 | 0.10 | 0.20 | 0.20 | 0.20 | 0.10 | 0.10 | 0.10 | 0.05 | | 1.25 |
| 33 | 9 | 0.20 | 0.10 | 0.20 | 0.20 | 0.20 | 0.10 | 0.10 | 0.10 | 0.05 | | 1.25 |
| 36 | 10 | 0.20 | 0.10 | 0.30 | 0.20 | 0.20 | 0.20 | 0.10 | 0.10 | 0.10 | | 1.40 |
| 39 | 12 | 0.30 | 0.10 | 0.30 | 0.30 | 0.30 | 0.20 | 0.10 | 0.10 | 0.10 | | 1.80 |
| 41 | 14 | 0.50 | 0.10 | 0.40 | 0.40 | 0.30 | 0.20 | 0.10 | 0.10 | 0.10 | 0.05 | 2.25 |
| 43 | 18 | 1.00 | 0.10 | 0.40 | 0.60 | 0.40 | 0.30 | 0.10 | 0.10 | 0.10 | 0.20 | 3.50 |
| 44 | 24 | 1.30 | 0.10 | 0.30 | 2.00 | 0.50 | 0.30 | 0.10 | 0.20 | 0.10 | 0.50 | 5.40 |
| | | Concrete shatters at 39KN | | | | | | | | | | |
FIG.16

METHOD FOR PRODUCING A REINFORCED CONCRETE PART, AND THUS-PRODUCED PART

The subject of the invention is a method for producing a reinforced concrete part and also covers the reinforcements used for this purpose and the concrete parts produced in this way.

The invention relates especially to the production of beams, slabs or floors subjected to deflection forces but may also be applied to other reinforced concrete parts, for example thin shells or sheer walls of varied forms.

Furthermore, the invention applies especially but in a nonlimiting manner to the construction of works that may be subjected to seismic shocks or accidental actions.

The reinforced concrete industry has expanded considerably over the 20th century, but this technique, while being the subject of very searching scientific studies, has changed relatively little.

The properties of the reinforced concrete result, as is known, from the combination of two materials that have different properties; concrete which essentially withstands compression forces and a reinforcing frame embedded in the concrete and consisting of metal bars which withstand the tensile forces, at least if the latter are oriented in the direction of the reinforcing bar. Prestressed concrete, invented by Freyssinet, relies on the same operating principles by simply giving the reinforcement subjected to tensile force a role for prestressing the part in the reverse direction of the tensile forces due to the load, which increases the resistance to the deflection forces.

In general, as is schematically shown in FIG. 1, it is accepted that a reinforced concrete part to which a load is applied comprises, on either side of a neutral line, a compressed part and a tensioned part subjected to tensile stresses under the effect of the load and consequently having a tendency to elongate. The reinforcing frame usually comprises two layers of longitudinal bars extending respectively in the compressed part and in the tensioned part and linked by a transversal mounting reinforcement consisting of straps that make it possible, on the one hand, to withstand the shearing forces and/or the no-load thrusts and, on the other hand, to securely attach together the two layers so as to form a frame that can be produced in advance then introduced into the casing.

When the part extends over a certain width, for example a slab, the ironwork frame comprises a number of longitudinal sections linked by transversal distribution reinforcements.

The reinforcing bars are securely attached to the concrete by an adhesion link determining, along each longitudinal bar, a tangential adhesion stress which varies according to the tensile stresses applied.

The assembly thus forms a composite part that has a tensioned part in which the concrete and the reinforcing bars, securely attached by adhesion, elongate together to a limit value from which the tensile stresses exceed the rupture limit of the stress of the concrete, causing the appearance of at least one crack in a portion of the part, with an increase in stresses and, therefore, the elongation of the reinforcing bar from which the concrete is freed from the appearance of the crack.

For example, if one studies the deflection behavior of a reinforced concrete part, typically reinforced with an ironwork, it is possible to establish a behavior law illustrated by FIG. 2 which is a moment-deflection diagram indicating, on the x axis, the elongation of the tensioned part resulting from the deformation of the part under the effect of the deflection moment indicated on the y axis.

In this typical behavior law, four successive areas can be differentiated.

The portion OA corresponds to the linear elastic behavior of the composite part with a simultaneous elongation of the concrete and of the reinforcement.

The portion AB corresponds to the creation of the cracking with an instantaneous increase in the deflection corresponding to the elongation of the tensioned portion with the steel-concrete adhesion brought into play.

From the point B, the tensile stresses are absorbed by the steels which are progressively loaded, over the range BC, to the level of their yield strength, the adhesion mechanism resulting in a relative slippage of the two materials, with a progressive increase in deflection to the point C from which the steel reaches its yield strength, with a progressive plasticization of the two materials.

It therefore appears that the deformation of the part according to the load applied depends on the tangential adhesion forces between each reinforcing bar and the concrete that coats it, which balance the tensile stresses resulting from the elongation tendency of the tensioned part.

It is known, in particular from the studies conducted by Albert Caquot, that the forces that oppose the slippage of the reinforcing bars are bonding, friction and abutment forces, in the case of so-called high-adhesion notched bars.

Bonding is a chemical adhesion phenomenon between the steel and the concrete. The friction phenomenon, which comes into play after separation of the bar, is due to the fact that an increase in the tensile force results in the appearance of cracks that are inclined relative to the axis of the bar and that form, in the concrete, frustums which are jammed onto the reinforcement by operating like ratchets or kinds of links.

However, this simple friction may be insufficient and, in order to have the concrete and steel work together up to a higher stress level, it is advantageous to use so-called high-adhesion reinforcing bars.

It has been proposed for a very long time to avoid the slippage of a reinforcing bar relative to the concrete which coats it by forming, along the bar, a plurality of spaced anchoring means forming abutments bearing on the concrete.

The document U.S. Pat. No. 843,843, for example, describes such a bar including spaced ribs and provides for giving a corrugated profile to the smooth portions extending between the ribs, in order to increase the perimeter and, consequently, the adhesion link.

Similar arrangements, comprising spaced ribs, are described for example in the French patents No. 420 102, 597 888 and 1 380 233.

Such spaced ribs however constitute only occasional abutments.

Currently, the high-adhesion bars are therefore provided, over their entire length, with blocking interlocks formed obliquely relative to the longitudinal direction of the bar, so as to produce a continuous blocking over the entire length thereof. Various known systems have been used for this purpose, the reinforcements being able, for example, to be twisted cold, or else provided with oblique imprints formed by cold rolling on the outer face of the bar.

The behavior, during the increase in the load, of such a high-adhesion bar is illustrated by FIG. 3 which is a so-called Tassios diagram representing the trend of the tangential adhesion stress $\tau$ according to the local slippage S of the bar relative to the concrete that coats it. Three successive stages are thus essentially differentiated.

In the first stage OA of FIG. 2, which corresponds to the normal loading for which the part has been designed, the reinforcement is elongated slightly with the concrete which is still within its elastic behavior range. The adhesion is then in a phase of resistance to separation of the reinforcement whose tendency to elongate is greater than that of the concrete which coats it. The tangential adhesion stress $\tau_A$ at the point A corresponds to the tensile rupture limit stress of the concrete, from which, as indicated above, transversal microcracks appear.

Because of this, in the second stage AB, it is possible to observe a small slippage of the reinforcement relative to the coating concrete, the adhesion being provided by shear then friction.

From the point B, for which the steel-concrete mechanical link reaches its shear resistance limit, the resistance to the slippage of the reinforcement is ensured by the abutment of the blocking notches or ribs formed on the surface of the bar. The result of this is a greater slippage of the bar up to the point C from which the crushing of the concrete between the blocking notches promotes the development of compression cracking. Beyond the point C a residual friction develops in the most highly stressed portions, up to complete rupture of the link.

It appears that the smooth reinforcing bars behave in the same way as the high-adhesion bars up to the point B from which the abutment effect of the blocking notches comes into play. From the point B which corresponds, for the smooth bars, to the rupturing of steel-concrete adhesion, the tangential adhesion stress diminishes rapidly and the slippage increases, as shown by the portion BE represented by dashes in FIG. 3.

As a general rule, the cracking that comes into play when the tensile strength of the concrete has been locally exceeded, occurs in the most stressed portions of the part.

The use of high-adhesion reinforcing bars, blocked over their entire length in the concrete, therefore makes it possible to increase the resistance to deformation and to cracking of the structure whose ironwork is determined for normal conditions of use, with a certain safety factor.

However, during the planned lifetime for a reinforced concrete construction, that is to say several decades, the cracks may progressively widen and cause the reinforcements to corrode. Furthermore, a localized increase in the stresses applied leads to a rupturing of the most stressed bars and, consequently, the destruction of the structure.

Such an increase in the stresses may occur, for example, in the regions subjected to seismic shocks and it is known that, in these regions, particularly significant shocks have been able to cause certain constructions to collapse. In the countries that are particularly subjected to this risk, for example in Japan, particular building construction techniques are used which make it possible to avoid, or at least considerably reduce this risk. However, these techniques are costly and unfortunately cannot be used in all the areas that are at risk. Because of this, high amplitude seismic shocks often result in extremely significant damage. Also, these techniques are usually applied to buildings but, even in Japan, it has become apparent that big structures like bridges could collapse.

The object of the invention is to resolve such problems by virtue of a novel technique for producing reinforced concrete parts.

The invention therefore relates, generally, to a method for producing a reinforced concrete part comprising, on either side of a neutral line, a compressed portion and a tensioned portion subjected to tensile stresses and having a tendency to elongate under the effect of the load supported by the part, and in which is embedded a reinforcing frame comprising, in the tensioned portion, at least one tensioned longitudinal bar securely attached to the concrete by an adhesion link determining, along said bar, a tangential adhesion stress varying according to the tensile stresses applied, respectively, to the bar and to the coating concrete, an increase in the tensile stress in the concrete above a limit value causing at least one crack to open with a transfer of the tensile stress to the bar and a corresponding elongation thereof, a method in which, at least in the most stressed portion of the part, said tensioned bar is provided with a plurality of spaced anchoring means forming abutments bearing on the coating concrete.

According to the invention, the anchoring means of the bar are distributed in a discontinuous series of spaced blocking areas each comprising a plurality of anchoring means (23) and separated from one another by slippage areas with no anchoring means, in each of which a local increase in the tensile differential between the bar and the concrete above a limit value results in a detachment of the bar relative to the concrete that coats it, over at least a portion of the length of said slippage area between two blocking areas, said detached portion being able to elongate without disturbing the coating concrete under the effect of the tensile stresses applied to the tensioned bar.

Also, because the part includes, in the concrete, randomly distributed areas of weakness, at the level of which an increase in the tensile stresses applied above the tensile strength of the concrete causes, in the most stressed portion of the part, at least one localized crack to appear at least in line with one of said areas of weakness, the opening of said crack determining, at this level, the cancellation of the tensile stress in the concrete and a correlative local increase in the tensile force applied to the reinforcing bar, with a corresponding increase in the tendency of the latter to elongate under the effect of the stresses applied.

According to a particularly advantageous characteristic of the invention, the local increase in the tensile force on the bar, at the level of a crack, determines a detachment of the bar relative to the coating concrete, at least in the slippage area that is closest to said crack and over a length such that the detachment force of the bar relative to the concrete at least partially compensates the tensile differential between the two materials when this differential causes the adhesion stress to be exceeded over the length concerned.

Furthermore, the remaining additional traction applied to the bar can be absorbed, at least partly, by the adjacent blocking area extending beyond the first slippage area, on the side opposite to the crack.

Because of this, according to another particularly advantageous characteristic of the invention, from the appearance of a first crack in a first area of weakness, the reinforcing bar detaches from the coating concrete in at least one first slippage area, closest to said crack, and an increase in the tensile stresses applied successively determines the opening of at least one secondary crack in another area of weakness of the concrete of the part and the detachment of the bar in at least one other slippage area, closest to said secondary crack, and so on as the tensile stresses applied increase, the sum of the thicknesses of the first crack and of the secondary cracks open at a determined instant being dependant on the increase in the elongation of the bar resulting from the increase in the stresses applied at that instant and this increase in the elongation being distributed over all the detached slippage areas, as and when the secondary cracks appear.

However, as indicated above, the cracks may occur in areas of weakness of the concrete which are randomly distributed.

In the case where a first crack is formed at the level of a first slippage area, the local increase in the tensile stress applied to the tensioned bar resulting from the opening of the crack results in a detachment of the bar on either side of said crack over a total length for which the work of detachment of the bar relative to the concrete at least partly compensates for the tensile differential between the two materials.

On the other hand, in the case where a first crack is formed at the level of a first blocking area, by causing a local increase in the pull applied to the tensioned bar, at least one first part of this pull increase is absorbed by the two portions of the first blocking area extending on either side of the crack and the remaining portion of the pull increase on the bar is compensated by the detachment force of the tensioned bar relative to the concrete at least over a portion of the closest slippage area.

Because of this, the number and the distribution of the blocking areas and the corresponding lengths of the slippage areas can be determined according to the distribution and the predictable values of the tensile stresses along each tensioned bar, given the loads applied, so that the thickness of each crack does not exceed a given limit.

Advantageously, the relative lengths of the blocking areas and of the slippage areas distributed along each tensioned bar are determined by taking into account their position, so as to give the part the necessary stiffness to remain within a range of values allowed for the deflection of the part under a given load.

According to another particularly advantageous characteristic of the invention, each blocking area extends over a length that is at least equal to a so-called sealing length of the reinforcing bar determining an adhesion stress that is at least equal to the maximum tensile stress acceptable for said bar, and not exceeding twice this sealing length.

The invention also covers the parts produced in this way and the reinforcing bars used to implement the method and comprising a discontinuous series of blocking areas separated from one another by slippage areas.

Normally, each slippage area of a tensioned longitudinal bar has a smooth outer surface in the longitudinal direction. However, each tensioned longitudinal bar having, in transversal section, the area necessary for the desired tensile strength, the profile of said bar, in each slippage area, may advantageously be adapted so as to give it the necessary perimeter for the contact surface between the bar and the concrete to provide a link by friction that makes it possible to reach the desired limit value of the tangential adhesion stress in said slippage area.

In particular, each tensioned longitudinal bar may have, in transversal section, a flattened profile with a width greater than the thickness, so as to increase the perimeter relative to that of a circular bar having the same transversal area.

Particularly advantageously, each tensioned longitudinal bar has, in transversal section, a corrugated profile with longitudinal portions, recessed and protruding, extending parallel to the axis of the bar, over the entire length of each slippage area.

In another particularly advantageous embodiment, each slippage area includes a layer of particles detachably fixed to the outer surface of the bar and extending so as to protrude into the coating concrete so as to increase the adhesion link with the concrete and the limit value of the adhesion stress from which an increase in the tensile stresses results in the detachment of the bar. In practice, these particles are progressively detached one after the other from the bar, by remaining included in the concrete, as the tensile stresses increase, which makes it possible to maintain the adhesion stress at its limit value over a range of increase of said tensile stresses.

These particles may consist of grains of sand or of gravel glued to the outer surface of the bar or else dusted and applied under pressure thereto, at high temperature, at the output of the mill.

These particles may also consist of metal balls or filings fixed to the outer surface of the bar by contact electrowelding.

Preferentially, the particles fixed in this way to the outer surface of each slippage area of the bar have varied dimensions so as to be progressively detached, depending on the size of the fixed portion, as and when the tensile stresses applied increase.

Other particularly advantageous characteristics of the invention will become apparent from the following description of certain particular embodiments, given as examples and illustrated by the appended drawings.

FIG. 4 is a diagram of a machine for testing deflection on a joist.

FIG. 4*a* is a diagram showing, for such a joist, variations in the pulls applied, respectively, to a tensioned bar and to the coating concrete.

Figure 5:
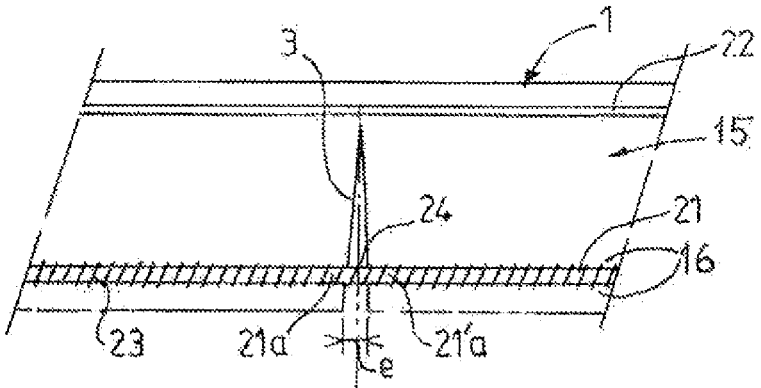

FIG. 5 is a schematic detail view, at the level of a crack and in longitudinal cross section, of a beam reinforced with high-adhesion bars of conventional type.

Figure 5A:
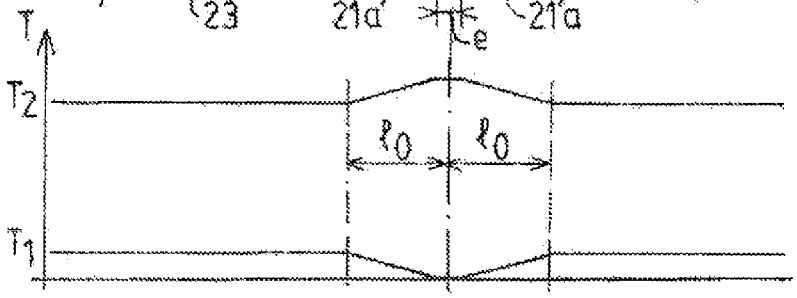

FIG. 5*a* is a diagram indicating, in the case of FIG. 5, the trend, at the level of a crack, of the pulls applied to a tensioned bar and to the concrete.

Figure 6:
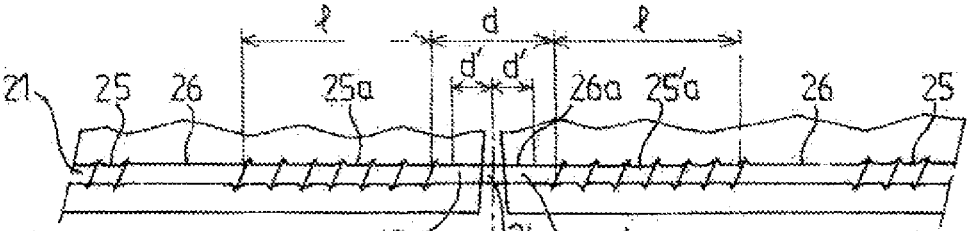

FIG. 6 is a detail view in longitudinal cross section of a part reinforced with reinforcing bars according to the invention, in the case of the formation of a crack in line with a slippage area.

Figure 6A:
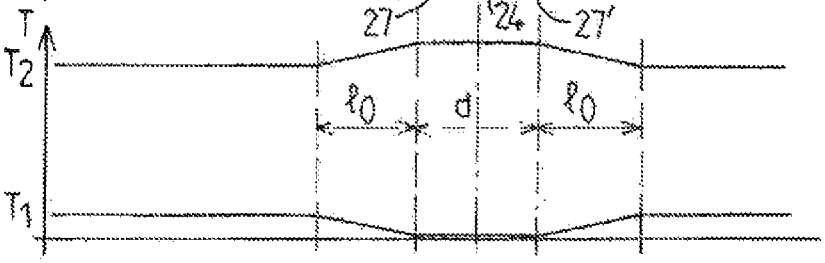

FIG. 6*a* is a diagram showing, in the case of FIG. 6, the variations of the pulls applied to a tensioned bar and to the concrete.

FIG. 7 shows two transversal cross-sectional views of a test joist, on the left in the vertical median plane and on the right at the level of a blocking area.

Figure 8:
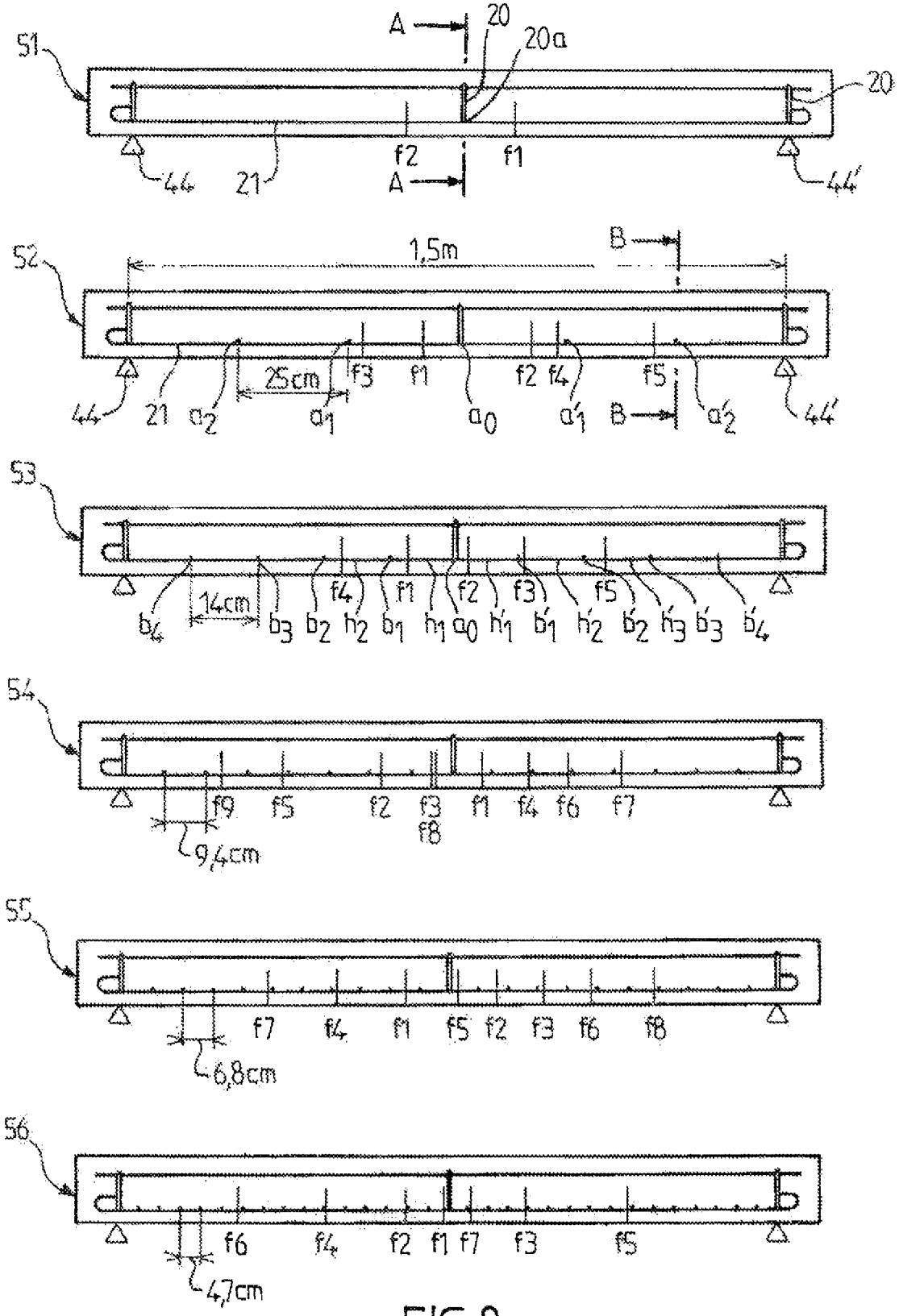

FIG. 8 illustrates the crack formation process on a number of joists subjected to a first series of deflection tests.

Figure 9:
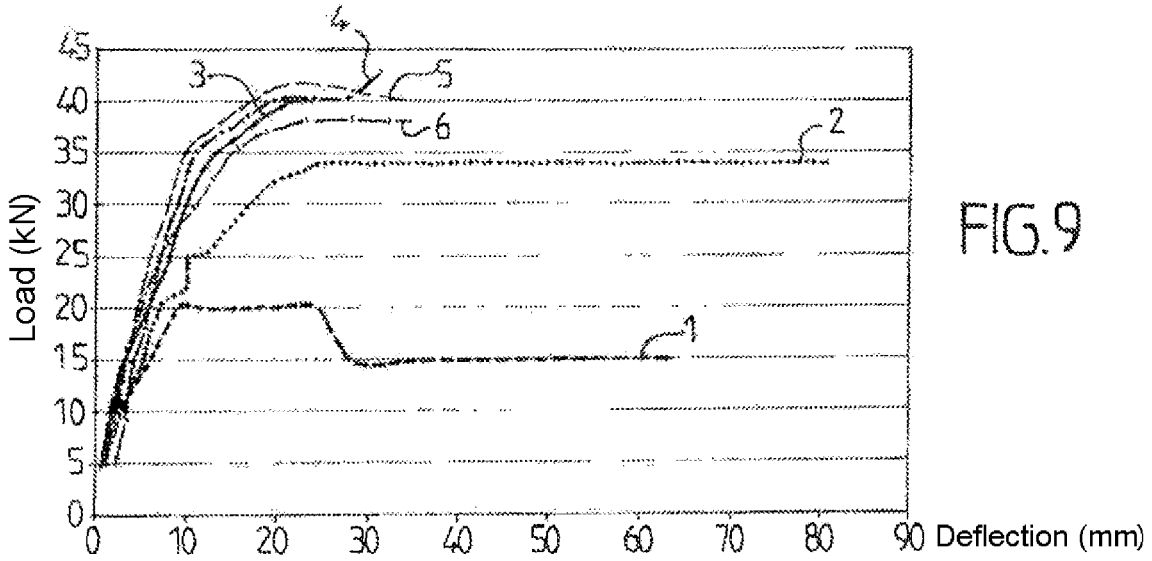

FIG. 9 is a diagram showing, for the various joists, the deflections obtained in this first series of tests, during the progressive increase in the load applied.

Figure 10:
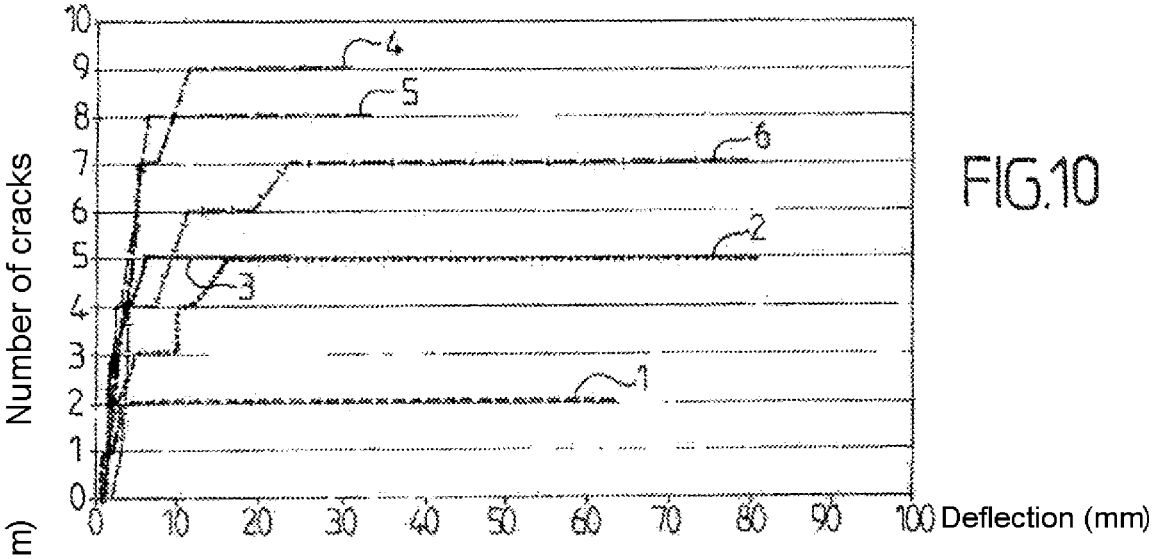

FIG. 10 is a diagram indicating, for the various joists, the number of cracks open according to the deflection.

Figure 11:
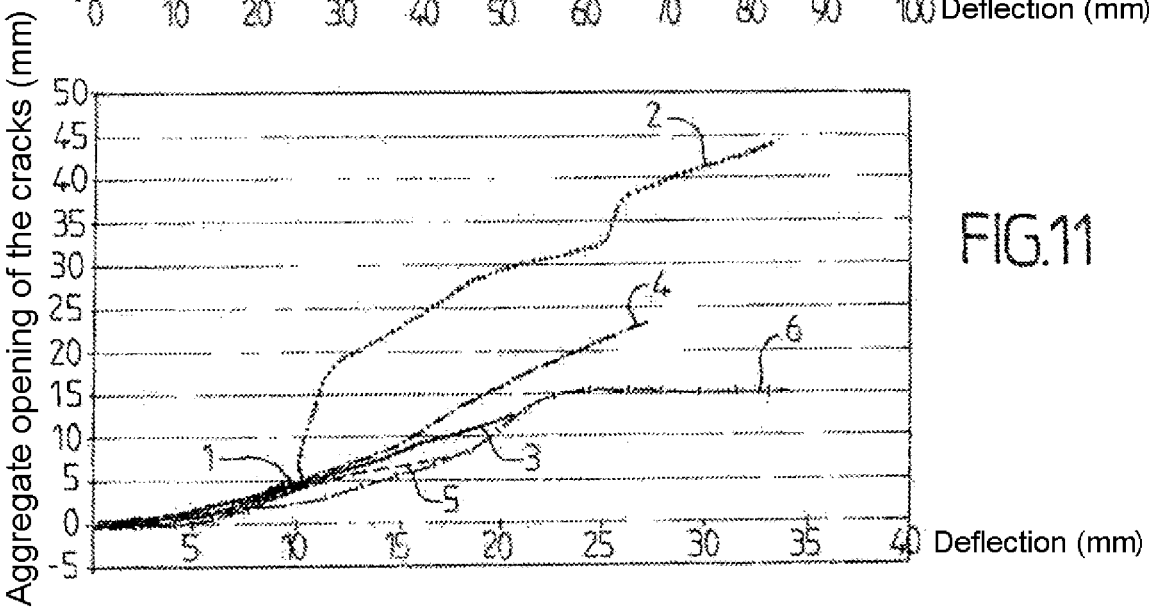

FIG. 11 is a diagram indicating, for the various joists, the aggregate opening of the cracks according to the deflection.

Figure 12:
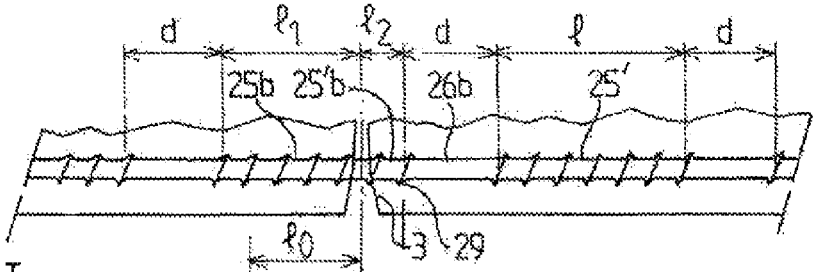

FIG. 12 is a detail view, in longitudinal cross section, of a part reinforced with reinforcing bars according to the invention, in the case of the formation of a crack at the level of a blocking area.

Figure 12A:
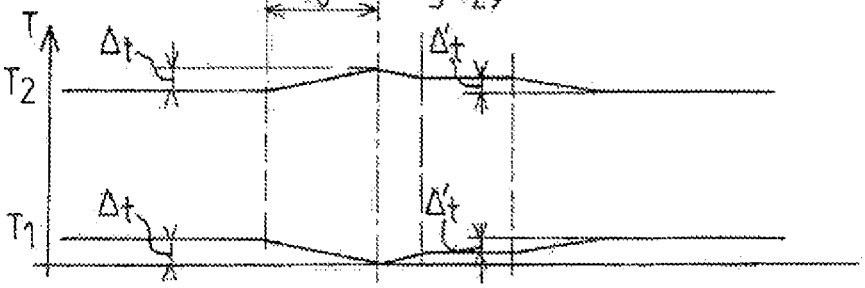

FIG. 12*a* is a diagram showing, in the case of FIG. 12, the variations of the pulls applied to a tensioned bar and to the concrete.

FIG. 13 is a schematic view of a device for testing pull-out on a metal bar embedded in a concrete test piece.

FIG. 14 shows, schematically, in longitudinal cross section and in transversal cross section, a second type of test joist provided with reinforcing bars according to the invention.

FIG. 15 is a table indicating the results of a second series of deflection tests performed on joists of the type of FIG. 14.

FIG. 16 is a table indicating, for a test joist, the order of appearance of the cracks, their location and their thicknesses according to the load applied.

FIG. 17 shows, in transversal section, a round bar and a flat bar, provided with directional imprints.

Figure 1:
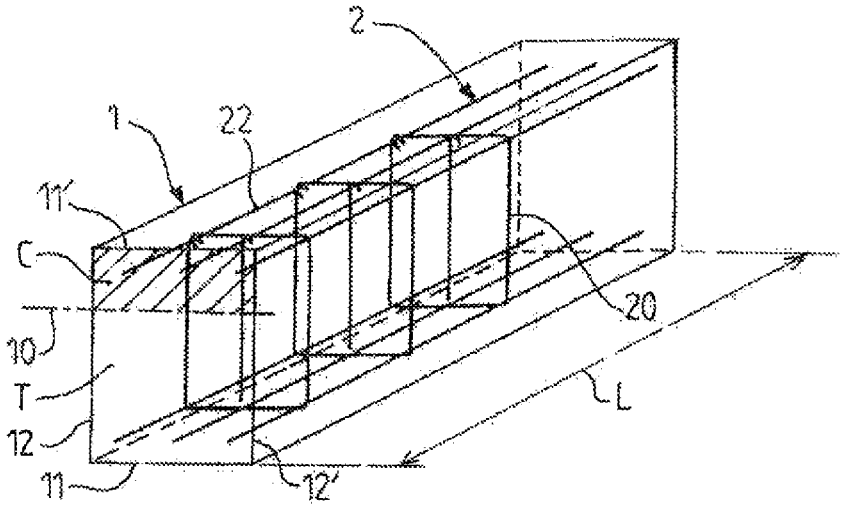
FIG. 1 is a perspective diagram of a reinforced concrete part such as a joist.

FIG. 1 schematically represents, in perspective, the conventional arrangement of a part 1 made of molded concrete 15, inside which is embedded a reinforcing frame 2. In the example represented, the part 1 is a beam with straight rectangular section, extending between two supports separated by a distance L and having two facing faces, respectively bottom 11 and top 11', and two vertical lateral faces, respectively 12, 12'.

As is known, when such a beam is subjected to a deflection force under the effect of a vertical load, its bottom portion T placed below a neutral line 10 is subjected to tensile stresses, and its top portion C is compressed. To withstand the stresses, the reinforcing frame 2 comprises two layers of longitudinal bars, respectively a bottom layer of so-called deflection bars 21, and a top layer of so-called mounting bars, 22, respectively parallel to the two facing faces, 11, 11' of the beam 1 and extending at a minimum coating distance therefrom. To withstand the shear force stresses, the two layers of longitudinal bars are linked by transversal reinforcements forming rectangular stirrups 20 separated from one another and distributed over the length of the beam.

All these arrangements are well known, FIG. 1 being a simple example. In particular, the number of reinforcing bars, their transversal cross-sectional areas and their disposition depend on the shape of the part and on the loads applied.

Figure 2:
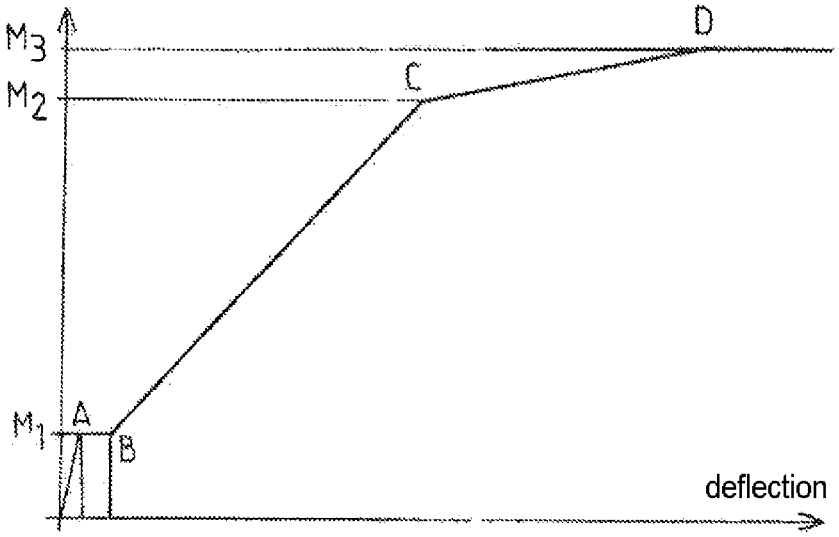
FIG. 2 is a moment-deformation diagram illustrating the behavior law of a part subjected to deflection forces.

FIG. 2 is a conventional moment-deformation diagram, illustrating the behavior of the part 1 when the latter is subjected to a progressively increasing deflection moment, indicated on the y axis and causing a deflection, indicated on the x axis, which increases with the load applied, by causing a corresponding elongation of the tensioned portion T and of the bottom facing face 11.

In the first portion OA of the diagram which corresponds to a linear elastic behavior of the part, the tensioned bars 21 and the concrete that coats them are securely attached by adhesion and are elongated simultaneously to a curvature C1, corresponding to the point A, from which the tensile stresses generated by the curvature of the part reach the tensile rupture limit stress of the concrete. Said concrete is then freed from the tensioned bars 21 which take up the tensile stresses alone. The result of this is a quasi-instantaneous increase of the curvature from C1 to C2, corresponding to the level AB, with an elongation of the tensioned bottom bars 21 and a start of cracking.

When the load and, consequently, the deflection moment increase, other cracks appear and progressively open. The part then follows a moment-deformation law that corresponds to the section BC whose slope depends on the adhesion mechanism which imposes a relative slippage of the tensioned bars relative to the concrete with, correlatively, a variation of the position of the neutral axis.

The slope of the straight line OA corresponds to the deflectional stiffness $E_cI$ of the part, $E_C$ being the modulus of elasticity of the non-cracked concrete and I its inertia. Similarly, the slope of the straight line OB corresponds to the stiffness $E_cI_f$, $I_f$ being the inertia of the part after the first cracking.

The steel reaches its elastic limit at the point C of the curve. The result is a progressive plasticization of the two materials and, consequently, a weak trend in the deflection moments and a low stiffness of the part which is reflected in a shallower slope of the section CD. The maximum deflection moment M3 which corresponds to the saturation of the capabilities of the weaker of the two materials, is reached at the point D from which the part has a zero stiffness, the deformation being able to continue with an elongation of the tensioned part as far as breakage of the reinforcing bars 21 which withstand the tensile stresses alone.

Figure 3:
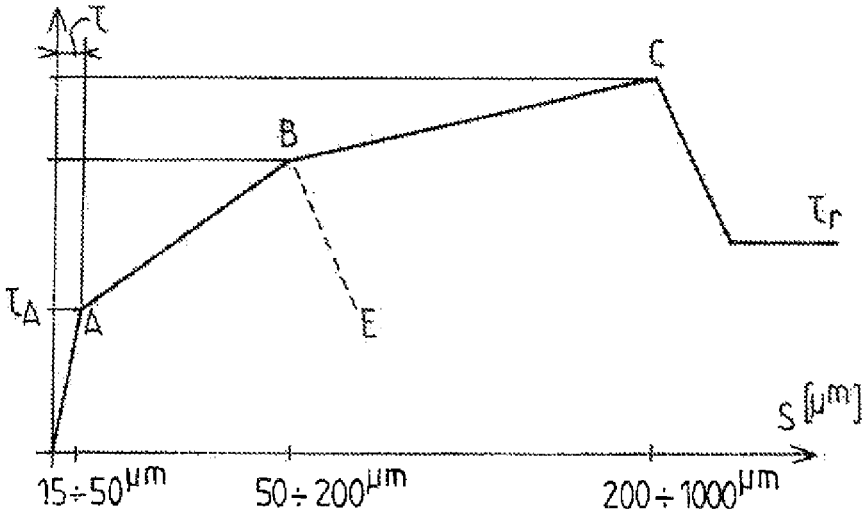
FIG. 3 is a stress-elongation diagram indicating, according to the type of reinforcement, the trend of the tangential adhesion stress according to the elongation of the reinforcement.

As indicated above, this behavior of the part under the effect of an increase in deflection moment is reflected in a corresponding trend in the tangential adhesion stresses along the tensioned bars 21, as illustrated by the diagram of FIG. 3.

It can be seen, in particular, that from a tangential stress $\tau_A$ corresponding to the tensile yield point of the concrete, there occurs a small slippage of the reinforcement with formation of microcracks, the tangential adhesion stress progressively increasing to a value $\tau_B$ which corresponds to the rupture of steel-concrete adhesion and from which the blocking notches or ribs of the high-adhesion bars come into play by abutting on the coating concrete. There then occurs a widening of the first cracks and a transversal cracking of the concrete which develops at the level of the ribs of the reinforcement until the adhesion stress reaches an ultimate value $\tau_u$ corresponding to the rupture of the steel-concrete link.

However, if this ultimate adhesion stress is greater than the maximum tensile stress that can be accepted by the steel, it is the reinforcing bar which gives way, thus resulting in the destruction of the construction.

The inventor has deduced therefrom that the phenomenon of rupture of the reinforcements which sometimes occurs in case of excessive increase in the stresses, for example because of seismic shocks, could be liked to the mode of operation of the high-adhesion reinforcing bars that are normally used to increase the tangential adhesion stress.

To resolve this problem, the inventor has therefore analyzed the behavior, in case of deflection under the effect of a load, of the tensioned portion of a reinforced concrete part such as a beam or a slab resting on two supports, in which is embedded a reinforcing frame comprising a bottom layer of high-adhesion bars which are provided, over their entire length, with transversal interlocks obliquely oriented relative to the longitudinal axis of the bar, in order to ensure a continuous secure attachment with the coating concrete.

As indicated above, by referring to FIG. 2, when the deflection moment applied to the part determines a curvature C1 for which the tensile stresses resulting from the elongation of the tensioned portion correspond to the maximum tensile strength of the concrete, one or more cracks begin to open.

When the load is localized, a first crack appears, normally, at the level of the point of application of said load. On the other hand, when the load is applied at two separate points, the tensile stresses are substantially the same between the two points of application of the load and result, in this portion of the part, in the appearance of a certain number of cracks.

These cracks are located relatively randomly because, in the casting, the constitution of the concrete, in particular the distribution, the grading and the degree of cleanliness of the aggregates, as well as the quality of the cement, may slightly vary, so that the part may include certain areas of structural weakness inherent to the quality of the concrete, for example air bubbles or more fragile or less clean aggregates, which favor the appearance of microcracks having a tendency to widen when the load applied and, consequently, the curvature of the part, increases.

Such is the case, in particular, when an excessive overload is applied to a concrete structure, for example when a bridge is crossed by a truck that exceeds the axle load limit, in the event of accidental impact of a vehicle on a bridge piling, or during a seismic shock.

As indicated above, the result of this is sometimes the rupture of certain reinforcing bars and the destruction of the structure.

The inventor sought to resolve such problems and studied in particular the conditions in which the reinforcement and the concrete work together to withstand the stresses applied.

To this end, he carried out deflection tests on reinforced joists in different ways, by observing in particular the location of the cracks, their order of appearance and by measuring their thicknesses, depending on the load applied.

FIG. 4 shows, for example, a deflection test machine 4 in the form of a frame, comprising a crossmember 41 fixed, at its ends, to two columns 42 between which is placed a test joist 5 resting on two spaced-apart supports 43 via spherical mountings 44, 44'.

The joist 5 is subjected, in its central portion, to a progressively increasing load by means of a jack 45 bearing, in one direction at the center of the crossmember 41 and, in the other direction, on the joist 5, via a spreader resting on two supports with spherical mountings 46, 46' spaced apart, for example, by a distance of 1 m.

By means of the jack 45, it is thus possible to subject the joist 5 to a progressively increasing deflection moment.

As indicated above, under the effect of the load applied, the tensioned portion T of the part has a tendency to elongate and, in the portion OA of the diagram of FIG. 2, the tensioned bars and the concrete are elongated in the same way. However, the tensile stresses that result therefrom are applied differently to the tensioned bars and to the concrete which are subjected, respectively, to pulls T1 and T2 in a ratio of approximately 1 to 15.

It can be accepted that the tensile stresses remain constant in the most stressed portion, between the two points 46, 46' of application of the load.

In the diagram of FIG. 4*a*, which shows the trend of the tensile stresses applied respectively to the concrete and to the reinforcing bars, the two curves T1, T2 therefore each represent a level between the points of application 46, 46'.

FIG. 5 is a schematic detail view showing, in longitudinal cross section, the behavior, in its most stressed portion, of a reinforced concrete beam 1 comprising, in its tensioned portion, a layer of high-adhesion reinforcing bars 21 consequently provided with ribs 23 over their entire length and in which a crack 3 opens. FIG. 5*a* is a diagram indicating on the y axis the tensile stresses applied, respectively, to a tensioned bar 21 and to the coating concrete.

As this diagram shows, when a crack 3 opens, the tensile stress T1 applied to the concrete is canceled at the level of the crack and the tensile stress T2 on the steel increases correlatively. The result of this is an increase in the elongation of the bar 21.

However, it is known that, in the case of a high-adhesion bar, the pull-out resistance of this bar is greater than its tensile strength if the sealed length exceeds a certain length called "sealing length", from which the bar is totally blocked in the concrete.

In the case of a reinforced concrete part, the length of a longitudinal reinforcing bar greatly exceeds this sealing length. Because of this, when an incipient crack 3 is created in the concrete, the two portions 21*a*, 21'*a* of the bar extending in the concrete, on either side of the crack 3, are totally blocked by the ribs 23 and it is therefore only the length of steel 24 corresponding to the thickness e of the crack which is subjected to the elongation.

In case of increase of the stresses, the width of the crack 3 may widen, for example by $1/10^{th}$ to $2/10^{ths}$, then $3/10^{ths}$ of a millimeter, which means that the free length of steel 24 in the crack will then double and then triple, the sealed portions 21*a*, 21'*a* remaining blocked in the concrete. Since no steel can withstand such an elongation, an excessive increase in the stresses resulting in a widening of the crack and, consequently, an excessive elongation of this small length of the bar will result, by striction, in the abrupt rupture of the latter with a risk of collapse of the structure.

The inventor therefore realized that it would be interesting to allow for a detachment of the concrete in the vicinity of the crack, so that the bar can be elongated by the necessary length under the effect of the pulls applied, without causing disturbance in the coating concrete or striction of the steel.

For this, he had the idea of including, in the high-adhesion bar, slippage areas without anchoring notches or ribs and thus allowing for a detachment of the bar without disturbing the concrete.

However, as indicated above, if the cracks are formed first in the most stressed portion of the part, their location remains random because it depends on the quality of the concrete which may not be absolutely uniform.

It is therefore advantageous, to take account of this random distribution of the cracks, to form, along a reinforcing bar, a number of smooth areas spaced apart from one another.

Also, the aggregate length of these smooth areas must be limited, so that each tensioned bar remains of the high-adhesion type over the greater portion of its length, in order to retain in the concrete part a stiffness that makes it possible to limit its deformation under deflection.

A novel type of reinforcing bar has therefore been developed, the principle of which is schematically represented in FIG. 6.

According to the invention, instead of being formed, as usually, over the entire length of the reinforcing bar 21 in order to produce a continuous blocking, the notches or ribs 23 are arranged in spaced apart blocking areas 25 each having a length l and separated from one another by an area 26 having a smooth surface and extending over a distance d.

As previously, the forces applied to the reinforced concrete part 1, for example a deflection moment, result in the elongation of the tensioned portion T of the part and, consequently, the tensioning of each tensioned bar 21 and of the concrete 16 that coats it, with the appearance of at least one incipient crack 3 when the tensile strength of the concrete 16 is exceeded.

An increase in the tensile stresses applied determines, correlatively, an increase in the adhesion stresses on either side of the portion 24 of a tensioned bar 21 corresponding to the opening of the crack 3 which, in the case of FIG. 6, is formed at the level of the smooth area 26 between two blocking areas 25.

In line with this crack 3, the tensile differential between the tensile stress of the steel T2 and that of the concrete T1 is at its maximum. When the shear stress applied by this tensile differential exceeds the pull-out resistance of the steel which is weaker in the smooth area 26*a* of the bar, the latter will be detached from the concrete.

There are therefore formed, on either side of the crack 3, two detached portions 27, 27' (FIG. 6) extending over a total length 2 d' which depends on the increase in the tensile stresses applied, due to the opening of the crack.

Because they are detached from the concrete, these two portions 27, 27' of the bar will be able to be elongated freely and the elongation corresponding to this increase in the tensile stresses will therefore be distributed over the length 2d' of the detached portion. For example, if the detached length 2d' is 50 mm, the bar 21 can be elongated by 50 to 50.1 then 50.2 then 50.3 millimeters if the crack widens from 0.1 to 0.2 then to 0.3 millimeters. A steel bar can perfectly withstand such an elongation distributed over a length of approximately 50 millimeters whereas, in the case of FIG. 4, this elongation would be limited to just the free portion 24 of the bar, corresponding to the width of the crack.

Furthermore, as and when the pull increases, the detachment will be able to extend over the entire length d of the smooth area 26*a*, along which the coating concrete is therefore no longer subjected to any tensile stress.

As FIG. 6*a* shows, the tensile stress T1 is then canceled over the entire length of the smooth area 26*a* and exhibits a level at this point, on either side of the crack 3, the tensile stress T1 on the steel increasing correlatively over a level of the same length. Consequently, the elongation of the bar which results therefrom will be distributed over this entire length d, without disturbing the concrete.

By virtue of this possibility of elongation of the bar 21 at the level of a crack, along a smooth area 26, it will therefore be possible to avoid, or at least considerably reduce, the risk of rupture of the reinforcements possibly resulting in the destruction and abrupt collapse of a structure.

A concrete beam or slab reinforced in this way will therefore better withstand the passage of a load exceeding the limit for which it was designed or even the localized overloads resulting from a seismic shock.

In practice, because the slippage areas can be distributed over the entire length of the reinforcements, it will be possible to benefit from the possibility of elongation of the latter at any point where cracks having a tendency to widen may form.

Also, in the detached area of the bar, the concrete is no longer driven by the steel. The crack therefore has less tendency to widen and no other crack can appear over the length d of the detached area 26*a* since the concrete is no longer tensioned.

The idea was then developed that, by distributing the smooth parts along each tensioned bar, it would be possible to enlarge the area in which cracks may randomly appear and increase the number thereof by correlatively reducing their maximum thickness.

To develop this novel type of high-adhesion reinforcement, a number of series of joists provided with reinforcing bars according to the invention were subjected to deflection tests performed in the same conditions on a test machine of the type represented in FIG. 4.

To allow for the comparisons, all these test joists were reinforced similarly by an ironwork frame 2 schematically represented, in transversal cross section, in FIG. 7, and in longitudinal cross section in the different views of FIG. 8. To take account primarily of the role of the tensioned bars, this ironwork frame 2 has a triangular shape comprising only three longitudinal bars, respectively two bottom bars 21 in the tensioned portion of the beam 5 and a top bar 22 in the compressed portion, said bars being linked by triangular straps 20.

FIG. 8 shows the results of a first series of deflection tests carried out on six types of joists, respectively 51 to 56, in which the reinforcing frames are produced in the same way and include, for simplicity, only three securing straps 20 respectively placed in the central part and at the two ends of each joist.

FIG. 7 schematically shows such an arrangement in its left-hand part which is a transversal cross-sectional view along the line A-A of FIG. 8, at the level of the central stirrup.

According to the invention, the bottom longitudinal bars of the test joists are provided with blocking areas whose number and distribution vary from one joist to another.

To facilitate the production of the blocking areas, these tensioned bars 21 are made of smooth metal strips with flattened section, as indicated in FIG. 7.

In the event, in this first series of tests, to simplify the production of the joists, flat bars with a smooth surface were used, these bars having simple blocking points produced by small iron crossmembers 28 welded to the planar top faces of the longitudinal bars 21 as is indicated in the right-hand part of FIG. 7 which is a transversal cross-sectional view along the line B-B of FIG. 8, the number and the distribution of these iron crossmembers varying depending on the type of test joist.

Thus, the first joist 51 schematically represented in the top part of FIG. 8 comprises a single central blocking point $a_0$ consisting of the bottom part 20*a* of the central strap 20, welded to the two bars 21 which, conventionally, are simply provided with anchoring tie bars at their two ends.

The second joist 52 is provided, on the other hand, with five blocking points comprising the same central blocking point $a_0$ and, on either side thereof, two pairs of iron crossmembers welded to the bars 21, and forming four blocking points, respectively $a_1$, $a_2$ on one side and $a'_1$, $a'_2$ on the other side.

The number and the spacings of the blocking points consisting of the iron crossmembers placed on either side of the central blocking point 20*a* and more or less spaced apart from one another can thus be varied, all the test joists having the same reach, for example 1.5 m between the supports 44, 44' for a distance of 0.30 m between the points of application of the load 46, 46'.

For example, in the case of the joist 52, the four iron crossmembers 27 forming, with the central iron bar 20*a*, the five blocking points $a_1$, $a_2$, $a_0$, $a'_2$, are spaced apart from one another by a distance of approximately 25 cm for a reach between supports of 1.5 m.

As FIG. 8 shows, the joist 53 comprises four iron crossmembers, on each side of the central iron bar 20*a* and, consequently, nine blocking points, respectively $b_1 \ldots b_4$, $a_0$, $b'_1$ $b'_4$ spaced apart from one another by approximately 14 cm. The joist 54 comprises seven iron crossmembers on each side of the central iron bar 20*a*, or 15 blocking points spaced apart by 9.4 cm. The joist 55 comprises 10 iron crossmembers on each side of the central iron bar 20*a*, or 21 blocking points spaced apart by 6.8 cm and the joist 56 comprises 30 iron crossmembers or 31 blocking points spaced apart by 4.7 cm.

All these joists were subjected to deflection tests in the same conditions and the appearance of microcracks was observed during the progressive increase in the load applied by the jack 45.

In the various diagrams of FIG. 8, vertical lines indicate the location of the cracks, as well as the order in which they appear.

Thus, on the beam 51 comprising only a central blocking point $a_0$, there was observed, on either side thereof, the successive appearance of two cracks, respectively a first crack $f_1$ on the right and a second crack $f_2$ on the left, these two cracks being located in the central portion, the most stressed portion, of the beam, substantially equidistant from the vertical median plane.

The joist 52 comprises, on each side of the central blocking point $a_0$, two blocking points spaced apart by a distance of approximately 25 cm for a reach of 1.5 m between the two supports 44, respectively $a_1$, $a_2$, on the left and $a'_1$, $a'_2$, on the right. During the increase in the deflection moment applied, a first crack $f_1$ to the left of the central blocking point $a_0$, a second crack $f_2$ to the right, a third crack $f_3$ to the left of the first crack $f_1$ and a fourth crack $f_4$ to the right of the second crack $f_2$ were seen to appear in succession.

Everything therefore occurred as if the slippage areas were attracting new cracks, thus avoiding a widening of the first crack $f_1$.

It was thus possible to observe that, by virtue of this particular construction of the tensioned reinforcing bars, from the appearance of a first crack and the detachment of the bar in a first slippage area between two blocking points, an increase in the tensile stresses applied successively determined the appearance of other cracks and the detachment of the bar first of all in the slippage areas adjacent to this first cracked area then, depending on the value of the stresses, in other more distant slippage areas, and so on, by moving further apart on either side of the first slippage area as and when the tensile stresses applied increased.

However, it can be seen that the cracks are not located perfectly symmetrically on either side of the median plane of the beam, because, as indicated above, the risk of a crack opening depends on the quality of the concrete which is not absolutely uniform.

For example, in the case of the beam 52 with five blocking points, the four cracks observed are located in the central portion of the beam, between the blocking points $a_1$ and $a'_1$, on either side of the central blocking point $a_0$.

In the case of the joist 53 provided with nine blocking points, the appearance of the first crack $f_1$ is observed on the slippage area $h_1$, to the left of the central blocking point $a_0$, followed in succession by the appearance, to the right of the central blocking point $a_0$, of a second crack $f_2$ on the slippage area $h'_1$, then a third crack $f_3$ on the slippage area $h'_2$, to the right of the blocking point $b'_1$, a fourth crack $f_4$ in the slippage area $h_2$ and a fifth crack $f_5$ in the slippage area $h'_3$ to the right of the blocking point $b'_2$.

FIG. 8 also shows the location and the order of appearance of the cracks on the joists 54 (15 blocking points), 55 (21 blocking points) and 56 (31 blocking points). It can be seen that, apart from the particular cases that may be due to the construction of the concrete, such as the crack $f_8$ for the joist 54 and the crack $f_7$ for the joist 56, these cracks are first of all located in the central portion of the joist then move increasingly further away from the median plane as the load applied by the jack 45 increases.

The use of reinforcing bars comprising an alternate series of spaced-apart slippage areas, separated from one another by spaced-apart blocking points, will therefore make it possible to distribute the cracking over a certain length of the beam, the appearance of a crack in a slippage area resulting in the detachment of the bar in this slippage area by canceling the tensile stress over all the detached coating concrete, so that the widening of the crack is limited in this detached area and that no other crack will therefore tend to form therein, this portion of the piece being, as it were, "vaccinated".

Thus, from the appearance of a first crack and the detachment of a tensioned longitudinal bar in a first slippage area, the progressive increase in the tensile stresses applied will successively determine the appearance of cracks and the detachment of the bar, first of all in or in the vicinity of the slippage areas situated on either side of this first cracked area then, depending on the value of the stresses, in other more distant slippage areas on either side of the first detached area and so on, by moving apart on either side thereof as the tensile stresses applied increase.

The idea was then developed that, by judiciously distributing blocking areas and slippage areas along the tensioned reinforcing bars, it would be possible to increase the number of secondary cracks appearing successively on either side of the area containing the first crack and, correlatively, reducing the thickness thereof, each secondary crack having a thickness such that the sum of the thicknesses of the first crack and of the secondary cracks open at a determined instant is dependent on the overall elongation of the bar resulting from the stresses applied at that instant. This elongation is therefore distributed over all the detached portions of the reinforcements which correspond to these secondary cracks, as and when they appear.

For the implementation of the invention, it will thus be possible to determine the number and the distribution of the blocking areas, their respective lengths and those of the slippage areas, according to the distribution and predictable values of the tensile stresses along each tensioned bar, so that the thickness of each crack does not exceed a given limit.

This is illustrated by the diagrams of FIGS. 9, 10 and 11 which combine the results of the tests carried out on the various joists.

FIG. 9 is a diagram indicating, for each joist, the deflection measured in the loading tests and corresponding to the load indicated on the y axis. It can be seen that each joist has a limit from which the curve tends toward an asymptote, the joist no longer opposing the resistance to deformation. As could be expected, this limit is lower for the curve 1 corresponding to the joist 51 of FIG. 8, the abrupt drop in resistance corresponding to the detachment of the tensioned reinforcements which has a smooth surface, on either side of the central blocking point 20*a*.

The curve 2 which corresponds to the joist 52 with five blocking points, has a higher limit and it will be noted that the increase in the number of blocking points gives the joist a greater resistance but only up to a certain limit. As it happens, the joist 56 that has thirty-one blocking points and corresponds to the curve 6 has a resistance a little lower than that of the joists 53, 54, 55.

It is found that the maximum resistance of these three joists is practically the same although the number of blocking areas varies by more than 40%. The addition of blocking points therefore makes it possible to increase the resistance of the joists but only up to a threshold beyond which this resistance diminishes. The best result is obtained for the beams 54 and 55 respectively corresponding to the curves 4 and 5 and respectively having fifteen and twenty-one blocking points.

FIG. 10 is a diagram indicating, on the y axis, the number of cracks that appear during the increase in deflection indicated on the x axis.

As indicated above, for the beam 51 that has only one central blocking point, only two cracks $f_1$, $f_2$ are seen to appear, with a width that therefore increases progressively as the deflection increases.

The greatest number of cracks is obtained for the joist 54 (curve 4) with nine cracks and for the joist 55 (curve 5) with eight cracks.

It should be noted that these cracks appear fairly rapidly, before the deflection exceeds 10 millimeters for a reach of 1.5 m between supports.

It is therefore interesting to relate this diagram to that of FIG. 11 which indicates, on the y axis, the aggregate opening of the cracks according to the deflection indicated on the x axis.

Apart from the curve 2 corresponding to the joist 52 with five blocking points, it is found that the aggregate opening of the cracks is almost the same for the other joists as long as the deflection remains insignificant.

The curves 4 and 5 corresponding to the joists 54 and 55 show that there is an optimum spacing between blocking points that makes it possible to obtain the greatest number of cracks with a limited aggregate opening, this spacing being a trade-off between the resistance of the beam and the number of cracks.

It therefore emerges from this first series of tests that the use of reinforcing bars comprising, according to the invention, a series of slippage areas separated by blocking points, makes it possible to distribute the cracking over an area that can range up to ⅔ of the length of the joist and, by thus increasing the number of cracks, to limit their openings. It will therefore be possible to more easily observe the regulation which demands a maximum opening that does not exceed 0.2 to 0.3 mm, at the most 0.5 millimeters and, consequently, to limit the risk of corrosion over time.

Furthermore, the alternation of the blocking points and of detachment areas makes it possible, at the level of each crack, to distribute the elongation of the tensioned bars over a fairly long length and, consequently, avoid the risk of rupture by striction of the reinforcing bars in the most stressed areas in case of excessive and/or localized increase in the tensile stresses.

However, in this first series of tests, carried out to study the influence of the slippage areas, the blocking points, consisting of simple iron crossmembers, were isolated. Now, as indicated above, it is preferable, in order to retain the desired stiffness of the part, for each reinforcing bar to remain of the high-adhesion type over the greater portion of its length, the slippage areas having a shorter length than the blocking areas between which they are formed, as is schematically represented in FIG. 6.

Furthermore, since the distribution of the cracks is random, it is possible that, in the most stressed portion of the part, blocking areas have a particular point of greatest weakness, such as an air bubble or a dusty aggregate, and that the crack is created at this point, as is schematically represented in FIG. 12.

In this case, as the diagram of FIG. 12*a* shows, the tensile stress T1 in the concrete is canceled in line with the crack 3 correlatively resulting in an increase in the tensile stress T2 which is taken up by the two portions 25*b*, 25'*b* of each tensioned bar 21 extending on either side of the crack 3.

Now, as indicated above, a high-adhesion bar is totally blocked in the concrete and withstands a tensile stress that can reach the yield point of the steel if it is sealed in the concrete over a minimum length $l_0$ which is called sealing length. This sealing length depends on the quality of the concrete and on the nature of the reinforcing bars. In the case of a round bar, this sealing length may be of the order of 10 to 12 times its diameter for a high-adhesion bar and from 20 to 25 times the diameter for a smooth bar.

This can be revealed by a pull-out test performed, for example, in the manner illustrated by FIG. 13, on a steel bar 6 sealed in a concrete test piece 60.

This bar 6 is extended outside the test piece 60 via a free portion 61 to which is applied a tensile force by clamping jaws 62, by means of jacks that are not represented bearing on the front face of the test piece 60.

By varying the forces applied and the length of the bar sealed in the test piece, it is possible to determine the minimum sealing length ($l_0$) of the bar from which it withstands the pull applied, without disturbing the concrete, up to the yield point of the steel, that is to say, up to rupture by striction of the bar 6 outside the test piece.

A measuring device 63 such as a spring balance, fixed to the opposite end 61' of the bar 6, can be used to check whether the length L sealed in the test piece 60 exceeds the minimum sealing length ($l_0$), the pull applied to the end 61' of the bar 6 opposite the jaws 62 then being zero.

In practice, the tensile stress applied by the jaws 62 to the front end 61 decreases progressively along the sealing length ($l_0$) and is zero over the remaining portion of the bar 6.

Similarly, as FIG. 12*a* shows, if, on one side of the crack, the length ($l_1$) of the portion 25*b* of the blocking area 25 is greater than the sealing length ($l_0$), the increase Δt in the pull applied to a bar 21, because of the opening of a crack 3, is at its maximum in line with the crack 3 and decreases progressively on either side of the latter, until it becomes zero at a distance ($l_0$) from the crack, the pull applied to the bar then returning to its average value T2.

On the other hand, if the length ($l_2$) of the remaining portion 25'*b* of the blocking area is less than the sealing length ($l_0$), this high-adhesion portion 25'*b* can absorb only a portion of the increase in pull Δt and, at its end 29, there therefore remains an additional stress Δ't which is transmitted to the adjacent slippage area 26*b*, the same additional stress Δ't having to be absorbed by the coating concrete.

The pull differential 2Δ't between the steel and the concrete is balanced by the tangential adhesion stress along this smooth portion 26*b*. Now, the tests show that, in the case of a smooth bar, the sealing length determining a total blocking of the bar relative to the coating concrete is of the order of 20 to 25 times its diameter.

Furthermore, as indicated above, the length of the smooth areas 26 formed along a tensioned bar 61 must be relatively limited in order not to excessively reduce the stiffness of the part. Consequently, the length d of the slippage area 26*b* of the bar is, normally, less than the sealing length $l'_0$ of an equivalent smooth bar, and this portion 26*b* will therefore be detached from the concrete under the effect of the pull differential 2Δ't, if the latter is greater than the tangential adhesion stress of this smooth area 26*b*. The two curves T1 and T2 then exhibit a level over the entire length of the slippage area 26*b*, as shown in FIG. 12*a*.

The additional traction Δ't is therefore applied to the next blocking area 25' and absorbed by the latter, the pull on the bar 61 then returning to its average value T2, in the same way as the pull absorbed on the concrete returns to its value T1.

However, such a detachment of the slippage area 26*b* presupposes that, at the end of the adjacent blocking area 25'*b*, there is still an additional pull of the steel relative to the concrete, and this is possible only if the portion 25'*b* of the blocking area does not exceed the sealing length $l_0$ of a high-adhesion bar. Furthermore, as has just been seen, it is essential for the length d of the adjacent slippage area 26*b* to be such that this area can be detached by this additional pull.

Furthermore, it appears that, in the case of the formation of a crack at the level of a blocking area, to avoid a total blocking of the bar relative to the concrete resulting in a risk of rupture by striction thereof, it is essential for the length of this blocking area to be less than twice the sealing length $l_0$. In this way, in fact, the increase in pull resulting from the formation of a crack at the level of a high-adhesion area will be absorbed only partially by one of the portions of this area placed on one side of the crack and transmitted to the adjacent slippage area which will be detached under the effect of the pull differential and therefore allow for a corresponding elongation of the bar.

Similarly, the length of each smooth area must not exceed the sealing length of an equivalent smooth bar, so that the pull differential between the steel and the concrete allows for its detachment at the end of the preceding blocking area.

Moreover, as indicated above, it is essential for the pull differential between the steel and the concrete, at the end of a blocking area, to be sufficient to result in the detachment of the adjacent slippage area. Now, this pull differential will be all the greater the shorter the blocking area.

It is therefore possible to deduce therefrom a correlation between the lengths of the blocking areas and those of the smooth areas which may be longer the shorter the preceding areas HA are, while remaining less than the equivalent sealing length.

For the production of the reinforcing bars according to the invention including alternating blocking areas and slippage areas, it will therefore be advantageous to adapt the number and the relative lengths of these areas, in order to choose an optimum distribution according to the desired result.

To this end, a second series of deflection tests were carried out in the same conditions, by means of a machine of the type represented in FIG. 4, on joists reinforced with bars according to the invention, and in which the number, the distribution and the relative lengths of the blocking areas and the slippage areas were varied.

FIG. 14 shows, in transversal cross section in its right-hand part and in longitudinal half-cross section in its left-hand part, such a test joist 7 in which is embedded an ironwork frame 2 comprising, as previously, two bottom longitudinal bars 71 and a top longitudinal bar 72 linked, at both ends and in the central portion of the beam, by triangular stirrups 70.

As previously, the tensioned bars 71 consist, in the tests carried out, of rectangular section strips having, for example, a width of 25 mm and a thickness of 3.5 mm.

The test joists produced in this way were subjected to deflection tests on a machine of the type represented in FIG. 4, with a distance of 0.30 m between the points of application of the load 46, 46' and a reach of 1.5 m between the support points 44, 44'.

In order to easily vary the number, the distribution and the relative lengths of the slippage areas and of the blocking areas, the latter were made up of high-adhesion iron sections (called HA) 73 welded to the longitudinal bars 71 and separated from one another by free areas 74. The use of flat bars 71 makes it easier to weld the iron bars HA 73 to the planar top face of the latter.

In this way, over the length of a longitudinal bar 71, it is possible to vary the number and the relative lengths of the high-adhesion iron bars 73 which form blocking areas and spaces 74 which form slippage areas, the reinforcement consisting solely, at this level, of a smooth strip.

It was thus possible to produce a series of test joists provided with reinforcing bars of different types, which were subjected to deflection tests by the application, on the spaced-apart supports 46, 46', of a progressively increasing vertical load.

During each test, the load applied and the corresponding deflection assumed by the joist in its median plane were measured and the order of appearance and the location of the cracks were identified, by measuring their thicknesses.

The table of FIG. 15 combines the results of deflection tests carried out on three series of five joists all having a length of 1.8 m for a reach between supports of 1.5 m and a distance of 0.30 m between the points of application of the load 46, 46'. To allow for the measurements, the joists were divided into sections with a width of 10 cm in order to identify the order of appearance of the cracks and locate them by measuring their distances relative to the left end of the joist, as indicated in the diagram of FIG. 16.

Each joist is identified by a three-digit number, the first two digits indicating the length, in centimeters, of the iron bars HA forming each blocking area and the third digit indicating the length, in centimeters, of the smooth areas interposed between two successive blocking areas.

Thus, the joist P061 comprises blocking areas of 6 cm separated by smooth areas of 1 cm.

The five joists of the first series therefore all include blocking areas that have a length of 6 cm separated by smooth areas whose length varies from 1 cm for the joist P061 to 5 cm for the joist P065.

For each joist, a record was kept, according to the load applied and as and when they appeared, of the number of cracks, the thickness of the widest crack and the deflection reached, at this moment, by the joist in its median plane. The table of FIG. 15 combines these results in columns which each correspond to a maximum width of the cracks.

For example, the joist P061 comprising blocking areas of 6 cm separated by smooth areas of 1 cm shows no crack under a load of 7.5 kN whereas the deflection is 3 cm in the median plane. On the other hand, under a load of 15 kN, 6 cracks are seen to appear, with a thickness not exceeding 0.1 mm, the deflection reached under this load being 5 cm.

Similarly, under a load of 30 kN, the deflection is 10 cm and 10 cracks are seen to appear with a maximum thickness of 0.3 mm.

For the joists of the second series, the blocking areas have a length of 10 cm and are separated by smooth areas whose length varies from 1 cm for the joist P101 to 5 cm for the joist P105.

The joists of the third series are provided with reinforcements comprising blocking areas of 14 cm separated by smooth areas with a length ranging from 1 to 5 cm.

As indicated above, all the test joints are reinforced with flat bars having an area, in transversal cross section, of 25×3.5 mm which corresponds to that of an equivalent round bar of diameter 10.5 mm for which the sealing length is from 10 to 15 cm. Even for the bars of the third series, the blocking areas have a length less than twice the sealing length and there is therefore no risk of determining a total blocking in case of formation of a crack at this level.

The table of FIG. 15 shows that the distribution of the blocking areas and of the smooth areas substantially influences the stiffness of the part, that is to say, the deflection assumed under a certain load, the number of cracks and their thicknesses.

It seems that the best configuration is that of the joists P101 and P102 comprising blocking areas of 10 cm and P141 and P142 comprising blocking areas of 14 cm. In practice, for one and the same maximum crack thickness, these joists can withstand a load greater than 25 to 30% of the load accepted by the other joists.

For example, for a maximum thickness of the cracks of 0.2 mm, the joists P101 and P102 withstand a load exceeding 30 KN whereas, for the other joists, such a load results in the opening of cracks having a thickness of 0.3 or even 0.5 mm.

Also, it seems preferable to limit the length of the slippage areas to 30 mm, preferably to 10 or 20 mm, the load supported, for one and the same maximum crack thickness, being less for slippage areas of 40 and 50 mm. In practice, the length of the slippage areas should be of the order of 5 to 30 mm.

However, the table of FIG. 15 shows that an interesting result can also be obtained with joists P062 and P063 which combine pairs of lengths HA that are short and smooth areas that are longer.

It therefore appears that, in certain cases, reduced blocking area lengths may be advantageous if they are combined with relatively long smooth areas allowing for a greater dissipation of energy when they are detached.

Such a combination would be particularly advantageous for structures constructed in areas with seismic risk or for applications with a risk of explosion or of violent impact.

As an example, the table of FIG. 16 indicates the trend of the cracking for the joist P102 which seems to give the best results since it can withstand a load ranging up to 39 kN, with a deflection of 12 cm, for a maximum crack thickness of 0.3 mm.

The joist is schematically represented above this table, in order to indicate the order of appearance and the location of the cracks.

In the table, the first two columns respectively indicate the load applied and the deflection measured in the middle of the joist, under that load.

The other columns indicate, for each of the cracks and according to their order of appearance, the thickness of this crack as a function of the load applied.

It might have been expected that the crack $f_1$ which appears first in the central portion of the joist always has a thickness that is greater than the others.

In reality, it emerges that, while the aggregate opening of the cracks, indicated in the last column of the table, increases as a function of the load applied, four cracks $f_2$, $f_3$, $f_4$, $f_5$ open very rapidly from a load of 15 kN, which then makes it possible to limit the opening of the first crack $f_1$ which has the same thickness as the cracks $f_3$, $f_4$, $f_5$ up to a relatively significant load, of 39 kN, for which this thickness of 0.3 mm still remains acceptable, the second crack $f_2$, more distant from $f_1$ having a slightly lesser thickness.

Moreover, it is from this maximum load of 39 kN that the compressed portion C of the joist begins to come apart, the load then being able to increase only slightly until the joist is destroyed, without disruption of the steels.

Also, the tests show that the cracking extends over a length of the order of ⅔ of the reach of the joist between the supports 44, 44' and that, from the start of cracking, the area where the first cracks appear is not limited to the central portion of the beam, between the points of application of the load 46, 46'. For example, in the case of the joist P102, the cracks $f_2$ and $f_3$ are formed outside this central portion 46, 46'.

As indicated above, all the joists were reinforced, in the tensioned portion T, with flat bars 71 having a transversal section of 25×3.5 mm, equivalent to a round bar having a diameter of approximately 10 mm. For the beam P102, the blocking areas therefore have a length of the same order as the sealing length $l_0$.

These two series of tests therefore confirm that the use of reinforcing bars comprising, according to the invention, an alternating series of blocking areas and of slippage areas makes it possible to distribute the cracking over a greater length of the part, possibly ranging up to ⅔ of the reach between supports and, thus, by multiplying the number of cracks, to reduce their thicknesses and substantially increase the load supported for a maximum crack thickness that is in line with the regulations, in order to avoid, in particular, the risk of corrosion of the reinforcements.

Furthermore, by forming, along the reinforcement, smooth areas that can be detached from the concrete and, thus, be freely elongated in line with or in the vicinity of a crack, the risk of rupture of the reinforcement by striction is avoided. This advantage is particularly important in areas with seismic risks, or even in case of explosion or violent impact. In practice, a portion of a structure such as a beam or a slab, for example, may possibly undergo a relatively significant deformation without rupture of the reinforcements and, consequently, without the risk of abrupt collapse of the structure, because of the distribution of the cracking over practically all of the reach of the part and the dissipation of energy by detachment of certain smooth areas. Similarly, a bridge span accidentally subjected to an excessive overload, for example, on the passage of an exceptional convoy, may be deformed with, possibly, the opening of numerous cracks which can subsequently be repaired, but without major risk to the strength of the structure.

However, the invention is evidently not limited to the details of the embodiments and examples that have just been described.

In particular, as indicated above, flat reinforcing bars consisting of metal strips were used to produce the test joists, the blocking areas thus being able to be simply constructed from bars HA welded to the planar faces of said strips. In practice, such an arrangement made it possible, for the tests, to easily vary the length of the blocking areas and their spacing.

However, the use of flat strips as reinforcing bars, which was the subject of the patent application EP 1 191 163 filed by the same applicant, offers many other advantages. In particular, as indicated above, the adhesion of the steel to the concrete being proportional to the contact surface area and, therefore, to the perimeter of the steel, a flat bar which has a perimeter approximately 1.6 times greater than that of an equivalent round bar having the same transversal section, offers a better adhesion. Also, the strength of the tensioned steels is a function of their section and of their lever arm, that is to say, the distance separating the center of gravity of the steel from that of the compressed portion of the concrete. Now, geometrically, this lever arm is substantially increased by the use of flat strips instead of round bars of the same section, because, as indicated in the document EP 1 191 163 cited above, the link stirrups between the two layers of bars can be welded or bonded to their internal faces, which makes it possible to place the longitudinal bars closer to the corresponding facing faces of the part, while observing the minimum coating distance. The result of this, furthermore, is that it is thus possible to produce thinner parts and, consequently, lighter parts, for the same resistance.

Moreover, in the tests carried out, the blocking areas consisted of simple bars HA welded to the internal faces of the flat strips. In reality, these blocking areas could be produced differently. For example, the flat strips used as reinforcements could be made of a plate remelted after rolling. It would then be possible, during rolling, to produce relief or hollowed-out imprints on both faces of the plate forming, after remelting, the wide faces of the strip.

However, while the use of flat bars as reinforcements offers multiple advantages, the invention can also be applied to all bar profiles, in particular round bars with circular section. In this case, as schematically indicated in FIGS. 6 and 12, the bars according to the invention would differ from the conventional high-adhesion bars by the fact that, during rolling, the blocking notches or ribs are not produced continuously over the entire length of the bar, but only over spaced-apart blocking areas, alternating with smooth slippage areas.

Moreover, the invention has been described in the case of a beam or a slab but can be applied to all sorts of structures and to all shapes of concrete parts such as beams, floors, slabs, shear wools, etc.

However, the use of reinforcing bars according to the invention offers yet more advantages.

In practice, the dissipation of energy necessary to the detachment of the steels relative to the concrete absorbs a portion of the energy causing the cracking such as a seismic shock, an earth movement or an accidental impact and therefore allows for a better overall resistance of the structure.

In this respect, it will be possible to modulate the resistance to detachment of the reinforcements in order to adapt it to specific stresses and, in particular, to determine the distribution and the relative lengths of the blocking areas and of the slippage areas according to the desired aim.

For example, the tests have shown that by producing blocking areas that have a length of the order of the sealing length, associated with fairly short detachment areas, not exceeding 20 mm, it was possible to increase the maximum acceptable load without exceeding a maximum crack thickness of 0.3 mm, corresponding to the regulations.

It would be possible, however, to increase the length of the slippage areas in order for their detachment to dissipate a maximum of energy in case of accidental impact or of seismic shock by then accepting a greater deformation under the effect of the loads applied or by reinforcing the iron work.

However, it is also possible to modulate the adhesion which is proportional to the contact surface area of the concrete on the steel, by acting on the profile, in transversal section, of the reinforcing bars. In particular, as indicated above, the use of reinforcing bars consisting of flat strips with oval or rectangular section makes it possible, for one and the same transversal cross-sectional area, to enlarge the perimeter and, therefore, the contact surface area and the energy necessary for the detachment.

To further increase this contact surface area without creating asperities in the direction of the future detachment, it would also be possible to form on the surface of the steel continuous imprints parallel to the longitudinal axis of the bar.

FIG. 17, for example, shows a round bar and a flat bar with rectangular section, both having, in transversal section, a corrugated profile with longitudinal portions, recessed 23 and protruding 24, which extend parallel to the longitudinal axis of the bar over the entire length of each slippage area.

However, it is also possible to act on the surface state of the steel by creating, on the surface of the bar, asperities consisting of particles detachably fixed to the outer surface of the bar and extending protruding into the coating concrete in order to increase the adhesion link and the limit value of the adhesion stress from which an increase in the tensile stresses results in the detachment of the bar. Advantageously, these protruding particles may be detached progressively one after the other by remaining included in the concrete, as and when tensile stresses are increased, so as to maintain the adhesion stress at a limit value over a range of increase of said stresses.

These particles could be fixed by bonding to the outer surface of the bar, for example by dusting large-grain sand on the latter, applied under pressure to the bar, at high temperature, at the output of the mill. It would also be possible to use metal particles such as steel chippings, balls or filings, fixed to the outer surface of the bar by thermowelding.

Such methods would make it possible to modulate the shear strength of the protuberances produced in this way. For the bonding, it would be possible to employ glues that are more or less resistant and to vary the size of the protuberances and, therefore, their bonded surface placed in contact with the steel.

It would also be possible to vary the size of the granules dusted on the bar and the pressure then applied or else the welding amperage when the welding is done electrically.

Such methods would make it possible to retain a planar contact surface between the steel and the concrete after detachment, because the separation rupture would not occur inside the concrete, as in the case of the steels HA, but at the steel/protuberance interface, by rupture of the bond or of the weld, each protruding particle remaining included in, without disturbing the interior of, the concrete, after detachment.

It therefore appears that the use, according to the invention, of reinforcing bars that have alternating blocking areas and slippage areas offers multiple advantages.

First of all, the distribution of the cracking over a long length of the part makes it possible, by increasing the number of cracks, to reduce their thickness, and, consequently, the risk of corrosion of the reinforcements over time. It would also be possible, because of the small opening of the cracks, to protect the reinforcements from the risk of corrosion by means of a coat of paint or of a suitable coating product.

Also, in case of excessive opening of a crack, the risk of rupture of the reinforcement by striction is avoided by allowing the reinforcement to be detached from the concrete over a length that can thus be elongated.

However, this detachment also results in a dissipation of energy and it will therefore be possible to determine the distribution and the relative lengths of the blocking areas and of the smooth areas so as to modulate the capacity of the part to withstand abnormal stresses without risk of collapse of the structure following an accidental rupture of the reinforcements.

In practice, for each structure, the distribution of the blocking areas and of the slippage areas can be determined according to the normal service load and the accidental loads against which protection should be provided, so that, in normal service, the tensioned reinforcements behave normally with a blocking of the bar relative to the coating concrete over its entire length and that, in case of accidental overload, the detachment of certain slippage areas, due to the steel/concrete stress differential allows, on the one hand, for an elongation of the reinforcements avoiding the risk of rupture and, on the other hand, results in a dissipation of energy that is capable of avoiding an abrupt collapse of the structure.

The invention thus provides the possibility of resolving a whole range of problems without compromising the general design of, and the method used to calculate, the ironwork frames, by using only reinforcing bars of a novel type but which can be produced industrially in a simple and inexpensive manner.

The invention claimed is:

1. A method for producing a reinforced concrete part (1) comprising, a step of molding concrete around at least one tensioned longitudinal bar (21) to form a reinforced concrete part, on either side of a neutral line (10), a compressed portion (C) and a tensioned portion (T) subjected to tensile stresses and having a tendency to elongate under the effect of the load supported by the part, and in which is embedded a reinforcing frame (2) comprising, in the tensioned portion, said at least one tensioned longitudinal bar (21) securely attached to the concrete by an adhesion link determining, along said tensioned longitudinal bar (21), a tangential adhesion stress varying according to the tensile stresses applied, respectively, to the tensioned longitudinal bar (21) and to the coating concrete (16), an increase in the tensile stress in the concrete above a limit value causing at least one crack (3) to open with a transfer of the tensile stress to the tensioned longitudinal bar (21) and a corresponding elongation thereof, at least in the most stressed portion of the part, said tensioned longitudinal bar (21) consisting in a discontinuous series of spaced blocking areas (25), each blocking area (25) comprising a plurality of anchoring means (23), the blocking areas (25) being separated from one another by slippage areas (26) with no anchoring means, the blocking areas and slippage areas being integrally formed in the tensioned longitudinal bar (21), wherein said slippage areas (26) are shorter than said blocking areas (25), and wherein each blocking area extends over a length that is at least equal to a sealing length ($l_0$) of the tensioned longitudinal bar (21) determining an adhesion stress that is at least equal to the maximum tensile stress that is acceptable for the tensioned longitudinal bar (21) and less than twice said sealing length ($l_0$) of the reinforcing tensioned longitudinal bar, each slippage area extends over a length less than a sealing length ($l'_0$) of a smooth bar with equivalent round section, whereby in each of the slippage areas, a local increase in the tensile differential between the tensioned longitudinal bar (21) and the concrete above a limit value results in a detachment of the tensioned longitudinal bar (21) relative to the concrete (16) that coats it, over at least a portion (27) of the length of said slippage area (26) included between two blocking areas (25*a*, 25'*a*), said detached portion (27) being able to elongate without disturbing the coating concrete (16) under the effect of the tensile stresses applied to the tensioned longitudinal bar (21).

2. The method as claimed in claim 1, in which, the part (1) comprising, in the concrete (15), areas of weakness inherent to the quality of the concrete and randomly distributed, at the level of which an increase in the tensile stresses apply above the yield strength of the concrete causes, in the most stressed portion of the part, the appearance of at least one localized crack (3) at least in line with one of said areas of weakness, the opening of said crack (3) determining, at this level, the cancellation of the tensile stress in the concrete and a correlative local increase in the tensile force applied to the reinforcing bar (21), with a corresponding increase in the tendency of the latter to elongate under the effect of the stresses applied, characterized in that the local increase in the tensile force on the bar (21), at the level of a crack (3), determines a detachment of the bar (21) relative to the coating concrete (16), at least in the slippage area (26*a*) that is closest to said crack (3) and over a length (d') such that the detachment force of the bar (21) relative to the concrete (16) at least partially compensates the tensile differential between the two materials when this differential causes the adhesion stress to be exceeded over the length concerned.

3. The method as claimed in claim 2, characterized in that, a portion of the tensile differential at the level of a crack (3) being compensated by the detachment of the concrete (16) in a first slippage area (26), the remaining additional traction applied to the bar (21) is absorbed, at least partly, by the adjacent blocking area (25'*a*) extending beyond the first slippage area (26*a*), on the side opposite to the crack (3).

4. The method as claimed in claim 3, characterized in that, from the appearance of a first crack (3) in a first area of weakness, the reinforcing bar (21) detaches from the coating concrete in at least one first slippage area (26*a*) , closest to said crack (3) , and that an increase in the tensile stresses applied successively determines the opening of at least one secondary crack (31) in another area of weakness of the concrete of the part (1) and the detachment of the bar (21) in at least one other slippage area (26*b*), closest to said secondary crack (31), and so on as the tensile stresses increase, the sum of the thicknesses of the first crack (3) and of the secondary cracks (31, 32, . . . ) open at a determined instant being dependent on the increase in the elongation of the bar resulting from the increase in the stresses applied at that instant and this increase in the elongation being distributed over all the detached slippage areas (26*a*, 26*b*, . . . ), as and when the secondary cracks (31, 32, . . . ) appear.

5. The method as claimed in claim 1, characterized in that, in the case where a first crack (3) is formed at the level of a first slippage area (26*a*), the local increase in the tensile stress applied to the tensioned bar (21) resulting from the opening of the crack (3) results in a detachment of the bar (21) on either side of said crack (3) over a total length (d') for which the detachment force of the bar (21) relative to the concrete at least partly compensates for the tensile differential between the two materials.

6. The method as claimed in claim 1, characterized in that, in the case where a first crack (3) is formed at the level of a first blocking area (25*a*) , by causing a local increase in the pull applied to the tensioned bar (21), at least one first part of this pull increase is absorbed by the two portions of the first blocking area (25*a*) extending on either side of the crack (3) and the remaining portion of the pull increase on the bar (21) is compensated by the detachment force of the tensioned bar (21) relative to the concrete at least over a portion of the closest slippage area.

7. The method as claimed in claim 1, characterized in that the relative lengths of the blocking areas (25) and of the slippage areas (26) distributed along each tensioned bar (21) are determined by taking account their position, so as to give to the part (1) the necessary stiffness to remain within a range of values allowed for the deflection of the part under a given load.

8. The method as claimed in claim 1, characterized in that each slippage area (26) extends over a length of the order of 5 to 30 mm.

9. The method as claimed in claim 1, characterized in that, each tensioned longitudinal bar (21) having, in transversal section, the area necessary for the desired tensile strength, the profile of said bar (21), in each slippage area (26), is adapted so as to give it the necessary perimeter for the contact surface between the bar and the concrete to provide a link by bonding and friction that makes it possible to reach the desired limit value of the tangential adhesion stress in said slippage area (26), characterized in that each tensioned longitudinal bar (21) has, in transversal section, a flattened profile with a width greater than the thickness, so as to increase its perimeter relative to that of an equivalent circular bar having the same transversal area, and characterized in that each tensioned longitudinal bar (21) has, in transversal section, a corrugated profile with longitudinal portions, recessed and protruding, extending parallel to the axis of the bar, over the entire length of each slippage area (26).

10. The method as claimed in claim 1, characterized in that, each tensioned longitudinal bar (21) having, in transversal section, the area necessary for the desired tensile strength, the profile of said bar (21), in each slippage area (26), is adapted so as to give it the necessary perimeter for the contact surface between the bar and the concrete to provide a link by bonding and friction that makes it possible to reach the desired limit value of the tangential adhesion stress in said slippage area (26), and characterized in that, in each slippage area (26), the outer face of the bar includes a layer of particles detachably fixed to the outer surface of the bar and extending so as to protrude into the coating concrete so as to increase the adhesion link with the concrete and the limit value of the adhesion stress from which an increase in the tensile stresses results in the detachment of the bar, said particles being progressively detached one after the other from the bar, by remaining included in the concrete, as the tensile stresses increase, so as to maintain the adhesion stress at its limit value over a range of increase of said tensile stresses.

11. The method as claimed in claim 10, characterized in that the particles consist of chippings, metal balls or filings and are fixed to the outer surface of the bar by contact electro-welding.

12. The method as claimed in claim 10, characterized in that the particles fixed to the outer surface of each slippage area of the bar have varied dimensions so as to be progressively detached, depending on the size of the fixed portion, as and when the tensile stresses applied increase.

13. The method as claimed in claim 1, wherein the lengths and the distribution of the blocking areas (25) and the corresponding lengths of the slippage areas (26) are determined according to the distribution and the predictable values of the tensile stresses along each tensioned bar (21), given the loads applied, so that the thickness of each of the cracks (3, 31, 32, . . . ) does not exceed a given limit.

14. A reinforced concrete method for implementing the method as claimed in claim 1, characterized in that each slippage area (26) of a tensioned longitudinal bar (21) has a smooth outer surface in the longitudinal direction.

15. The method as claimed in claim 14, characterized in that, each tensioned longitudinal bar (21) having, in transversal section, the area necessary for the desired tensile strength, the profile of said bar (21), in each slippage area (26), is adapted so as to give it the necessary perimeter for the contact surface between the bar and the concrete to provide a link by bonding and friction that makes it possible to reach the desired limit value of the tangential adhesion stress in said slippage area (26).

16. The method as claimed in claim 15, characterized in that each tensioned longitudinal bar (21) has, in transversal section, a flattened profile with a width greater than the thickness, so as to increase its perimeter relative to that of an equivalent circular bar having the same transversal area.

17. A method for producing a reinforced concrete part (1) that comprises, a step of molding concrete around at least one tensioned longitudinal bar (21) to form a reinforced concrete part, on either side of a neutral line (10), a compressed portion (C) and a tensioned portion (T) subjected to tensile stresses and having a tendency to elongate under the effect of the load supported by the part, and in which is embedded a reinforcing frame (2) that comprises, in the tensioned portion, the at least one tensioned longitudinal bar (21) securely attached to the concrete by an adhesion link determining, along said tensioned longitudinal bar (21), a tangential adhesion stress varying according to the tensile stresses applied, respectively, to the tensioned longitudinal bar (21) and to the coating concrete (16), an increase in the tensile stress in the concrete above a limit value causing a crack (3) to open with a transfer of the tensile stress to the bar (21) and a corresponding elongation thereof, said tensioned longitudinal bar (21) being integrally forming with a discontinuous series of spaced-apart blocking areas (25), the blocking areas (25) comprising a plurality of anchoring elements (23) forming abutments bearing on the coating concrete (16), whereby said tensioned bar (21) consists in the anchoring elements being separated from one another by slippage areas (26) that have no anchoring element, said slippage areas (26) being shorter than said blocking areas (25), said blocking areas extending over a length that is at least equal to a so-called sealing length ($l_0$) of the bar (21) determining an adhesion stress that is at least equal to the maximum tensile stress that is acceptable for the bar (21) and less than twice said sealing length ($l_0$) of the reinforcing bar, and each slippage area extending over a length less than a sealing length ($l'_0$) of a smooth bar with equivalent round section, whereby a local increase in tensile differential between said tensioned bar (21) and the coating concrete above a limit value results in a detachment of said tensioned bar (21), relative to the coating concrete (16) that coats said tensioned bar (21), over at least a portion (27) of a length of one of said slippage areas (26) and opening of the crack (3) between two adjacent blocking areas (25*a*, 25'*a*), said detachment resulting in a detached portion (27) being able to elongate without disturbing the coating concrete (16) under the effect of the tensile stresses applied to the tensioned bar (21).

18. A reinforced concrete method for implementing the method as claimed in claim 17, wherein, each anchoring element is a rib, and each slippage area (26) has a smooth outer surface in the longitudinal direction free of any said rib.

19. The method as claimed in claim 17, wherein the lengths and the distribution of the blocking areas (25) and the corresponding lengths of the slippage areas (26) are determined according to the distribution and the predictable values of the tensile stresses along each tensioned bar (21), given the loads applied, so that the thickness of each of the cracks (3, 31, 32, . . . ) does not exceed a given limit.

* * * * *